US007738829B2

(12) United States Patent
Hatakeyama et al.

(10) Patent No.: US 7,738,829 B2
(45) Date of Patent: Jun. 15, 2010

(54) PROCESS CARTRIDGE INCLUDING PHOTOCONDUCTOR PRE-COATED WITH PROTECTIVE AGENT AND IMAGE FORMING APPARATUS USING SAME

(75) Inventors: Kumiko Hatakeyama, Sagamihara (JP); Toshiyuki Kabata, Yokohama (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 12/101,667

(22) Filed: Apr. 11, 2008

(65) Prior Publication Data

US 2008/0253801 A1 Oct. 16, 2008

(30) Foreign Application Priority Data

Apr. 13, 2007 (JP) ..... 2007-106214
Feb. 14, 2008 (JP) ..... 2008-033704

(51) Int. Cl.
*G03G 21/00* (2006.01)

(52) U.S. Cl. ..... 399/346; 399/111; 399/116; 399/25

(58) Field of Classification Search ..... 399/346
See application file for complete search history.

(56) References Cited

U.S. PATENT DOCUMENTS 7,218,879 B2 5/2007 Enoki et al.
7,315,711 B2 1/2008 Ariizumi et al.
2001/0031411 A1* 10/2001 Kojima et al. ..... 430/58.05
2004/0165919 A1* 8/2004 Nishida ..... 399/346
2005/0169668 A1 8/2005 Koichi et al.
2005/0196193 A1* 9/2005 Tamoto et al. ..... 399/111

FOREIGN PATENT DOCUMENTS

JP 2004-198662 7/2004
JP 2005-4051 1/2005
JP 2005-17469 1/2005
JP 2005-249901 9/2005

OTHER PUBLICATIONS

U.S. Appl. No. 12/168,336, filed Jun. 7, 2008, Hatakeyama, et al.

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A process cartridge includes a protective agent, a photoconductor, a charging unit, a development unit, a cleaning unit, and an application unit. The protective agent includes paraffin as main component. The photoconductor has a surface including polycarbonate applied with the protective agent. The development unit develops a latent image on the photoconductor. The cleaning unit removes materials remaining on the photoconductor. The application unit applies the protective agent to the surface of photoconductor. One peak in a given binding energy range is used to determine a coating condition of the photoconductor coated by the agent. The coating condition is determined by comparing an area ratio $A_0$ before applying the agent and an area ratio A after applying the agent, each of which is an area ratio with respect to a total area of C1s spectrum of the photoconductor. The coating ratio of the photoconductor is computed by $(A_0-A)/A_0\times100$.

18 Claims, 7 Drawing Sheets

FIG. 8

| EXPER-IMENT NO. | PHOTOCONDUCTOR | | | PROCESS CARTRIDGE | | | | | EVALUATION RESULT |
|---|---|---|---|---|---|---|---|---|---|
| | PROTECTIVE AGENT | APPLICATION METHOD | COATING RATIO (%) | PROTECTIVE AGENT | BRUSH | | | CHARGING PROCESS | |
| | | | | | DIAMETER (μm) | NUMBER | PRESSURE (N) | | |
| 1 | 2 | BAR/BRUSH/BLADE | 100 | BAR NO. 2 | 33 | 50000 | 4.8 | AC CHARGING | A |
| 2 | 2 | BAR/BRUSH/BLADE | 100 | BAR NO. 2 | 39 | 50000 | 4.8 | AC CHARGING | A |
| 3 | 1 | BAR/BRUSH/BLADE | 45 | BAR NO. 1 | 39 | 30000 | 2.0 | AC CHARGING | C |
| 4 | 1 | BAR/BRUSH/BLADE | 100 | BAR NO. 1 | 33 | 50000 | 4.8 | AC CHARGING | A |
| 5 | 1 | POWDER/BLADE | 58 | BAR NO. 1 | 30 | 55000 | 4.8 | AC CHARGING | C |
| 6 | 1 | POWDER/BLADE | 64 | BAR NO. 1 | 30 | 55000 | 4.8 | AC CHARGING | B |
| 7 | 1 | POWDER/BLADE | 72 | BAR NO. 1 | 30 | 55000 | 4.8 | AC CHARGING | A |
| 8 | 1 | POWDER/BLADE | 86 | BAR NO. 1 | 30 | 55000 | 4.8 | AC CHARGING | A |
| 9 | 1 | POWDER/BLADE | 98 | BAR NO. 1 | 30 | 55000 | 4.8 | AC CHARGING | A |
| 10 | 1 | POWDER/BLADE | 58 | BAR NO. 1 | 30 | 55000 | 4.8 | DC CHARGING | C |
| 11 | 1 | POWDER/BLADE | 64 | BAR NO. 1 | 30 | 55000 | 4.8 | DC CHARGING | A |
| 12 | 1 | POWDER/BLADE | 72 | BAR NO. 1 | 30 | 55000 | 4.8 | DC CHARGING | A |
| 13 | 1 | POWDER/BLADE | 86 | BAR NO. 1 | 30 | 55000 | 4.8 | DC CHARGING | A |
| 14 | 1 | POWDER/BLADE | 98 | BAR NO. 1 | 30 | 55000 | 4.8 | DC CHARGING | A |
| 15 | 1 | APPLIED BY MELTING | 95 | BAR NO. 1 | 33 | 50000 | 4.8 | AC CHARGING | A |
| 16 | | | 0 | ZINC STEARATE | 33 | 50000 | 4.8 | AC CHARGING | C |

PROCESS CARTRIDGE INCLUDING PHOTOCONDUCTOR PRE-COATED WITH PROTECTIVE AGENT AND IMAGE FORMING APPARATUS USING SAME

CROSS-REFERENCE TO RELATED APPLICATIONS

This application claims priority from Japanese Patent Application Nos. 2007-106214, filed on Apr. 13, 2007, and 2008-033704, filed on Feb. 14, 2008 in the Japan Patent Office, the entire contents of each of which are hereby incorporated by reference herein.

BACKGROUND OF THE INVENTION

1. Field of the Invention

The present disclosure generally relates to a process cartridge used for an image forming apparatus, and more particularly, to a process cartridge having a function of applying a protective agent to a photoconductor.

2. Description of the Background Art

Typically, an image forming apparatus using electrophotography produces an image by sequentially conducting a series of processes such as a charging process, an exposure process, a developing process, and a transfer process to a photoconductor such as an OPC (organic photoconductor). After conducting the transfer process, by-products generated by discharging during the charging process or toner particles remaining on the photoconductor are removed by a cleaning process. Such cleaning process can be conducted by using a cleaning blade, such as a rubber blade, which has a relatively simple and inexpensive structure but which cleans well.

However, such cleaning blade has a short lifetime and itself reduces the useful life of the photoconductor because the cleaning blade is pressed against the photoconductor to remove residual materials remaining on the photoconductor. More specifically, frictional pressure between the cleaning blade and the photoconductor causes abrasion on the rubber blade and a surface layer of a photoconductor.

Further, small-sized toner particles, used for coping with demand for higher quality images, may not be effectively trapped by such a cleaning blade, referred to as "passing of toner" or "toner passing." Such toner passing is more likely to occur by insufficient dimensional or assembly precision of the cleaning blade or when the cleaning blade vibrates unfavorably due to an external shock or the like. If such toner passing occurs, higher quality images may not be produced.

Accordingly, to enhance the lifetime of the photoconductor and to produce higher quality images over time, frictional pressure on the photoconductor or cleaning blade needs to be reduced, and a cleaning performance of the photoconductor needs to be enhanced, by which degradation of the photoconductor or cleaning blade can be reduced and the aforementioned "toner passing" can be reduced.

In view of such frictional pressure reduction and cleaning performance enhancement, in general, a lubricant is applied to the photoconductor to form a lubricant layer on the photoconductor using the cleaning blade. Such lubricant layer can protect the surface of the photoconductor from an effect of frictional pressure caused by the cleaning blade pressing against the photoconductor, which abrades the photoconductor, or from a discharge energy effect during a charging process, which degrades the photoconductor. Further, the photoconductor having such lubricant layer can enhance lubricating performance of the photoconductor surface, by which an unfavorable vibration of cleaning blade can be reduced, and thereby toner passing amount can be reduced.

In general, a metallic soap such as zinc stearate is used as the lubricant. However, zinc stearate may adhere to a charge roller of an image forming apparatus and cause unfavorable charging condition, which may result in a lower quality image, for example an image having black streaks.

Research indicates that paraffin can be used as a protective agent providing good lubrication and protection. However, paraffin requires more time to coat the surface of photoconductor compared to zinc stearate after application, by which the photoconductor has some areas coated with paraffin and other areas not coated with paraffin. Such uneven coating may occur when an image forming apparatus, newly shipped from a factory, is used for an image forming operation for the first time. In view of such coating condition, a photoconductor coated with paraffin in advance can be prepared when assembling the image forming apparatus.

Accordingly, the state of the lubricant application on the photoconductor, such as application amount, needs to be evaluated. When zinc stearate is used as the lubricant, a lubricant amount of zinc stearate applied to a photoconductor is analyzed using XPS (X-ray photoelectron spectroscopy), in which the amount of zinc element as a percentage of all elements on the surface of photoconductor is measured.

In XPS analysis, elements other than hydrogen element existing in a top and a sub-surface of a sample can be detected. When an OPC (organic photoconductor) coated with zinc stearate is analyzed using XPS, an element amount profile detected by XPS varies depending on a coating amount or coating ratio of zinc stearate. For example, when no zinc stearate is applied to the OPC, the element amount profile shows an element distribution of the OPC itself, whereas when zinc stearate is applied to the OPC, the element amount profile shows a mixture of the element distribution of the OPC and the element distribution of the zinc stearate. If the zinc stearate is applied to the entire surface of the OPC (i.e., OPC is coated with zinc stearate 100%), the element amount profile only shows the element distribution of the zinc stearate, and therefore an upper limit of zinc amount or ratio on the OPC becomes a zinc amount or ratio of the zinc stearate. Accordingly, when zinc stearate, which has a chemical composition of $C_{36}H_{70}O_4Zn$, coats the entire surface of the photoconductor, theoretically the ratio of zinc to all elements should be 2.44%, which is computed from the ratio of elements in zinc stearate ($C_{36}H_{70}O_4Zn$) excluding hydrogen.

However, when a protective agent, such as paraffin, not containing metal component is applied to the OPC, XPS analysis shows only peak values for carbon (C) and oxygen (O), and therefore the amount of protective agent applied to the photoconductor may not be correctly evaluated.

If the amount of protective agent on a photoconductor cannot be correctly evaluated, a photoconductor having an insufficient amount of protective agent may be assembled in a process cartridge or an image forming apparatus, and such photoconductor can cause image quality degradation.

As such, a conventional analysis method may not be suitable for detecting an amount of a protective agent, such as paraffin, not including metal component. In view of such background, a method of correctly evaluating a surface condition of a photoconductor coated with a protective agent not including metal component is desired.

SUMMARY

In view of the aforementioned background, the present disclosure discloses a process cartridge and an image forming apparatus having a photoconductor effectively coated with a protective agent.

In an aspect of the present disclosure, a process cartridge includes a protective agent, a photoconductor, a charging unit, a development unit, a cleaning unit, and an application unit. The protective agent includes paraffin as a main component. The photoconductor has a surface including polycarbonate to be applied with the protective agent, to which a latent image is to be formed. The charging unit uniformly charges the photoconductor. The development unit develops the latent image formed on the photoconductor as a toner image using a developing agent including toner particles. The cleaning unit removes toner particles remaining on the surface of the photoconductor after the toner image is transferred to a transfer member. The application unit applies the protective agent to the surface of photoconductor. A C1s spectrum of the photoconductor, detected by X-ray photoelectron spectroscopy (XPS) analysis before and after applying the protective agent on the photoconductor, includes a plurality of peaks, corresponding to different carbon binding energy. One of the plurality of peaks in a binding energy range of 290.3 eV to 294 eV is used as target peak to determine a coating condition of the photoconductor coated by the protective agent. A peak area of the target peak with respect to a total area of C1s spectrum of the photoconductor is detected before and after applying the protective agent as a first peak area ratio $A_0$(%) and a second peak area ratio A(%) to determine a coating condition of the photoconductor, respectively. The first peak area ratio $A_0$(%) is detected as a value before applying the protective agent, and the photoconductor having the first peak area ratio $A_0$(%) of 3% or more is employed. The second peak area ratio A(%) is detected as a value after applying the protective agent. The photoconductor is applied with the protective having a coating ratio of 60% or more, computed by $(A_0-A)/A_0\times100$(%).

In another aspect of the present disclosure, an image forming apparatus includes a process cartridge. The process cartridge includes a protective agent, a photoconductor, a charging unit, a development unit, a cleaning unit, and an application unit. The protective agent includes paraffin as a main component. The photoconductor has a surface including polycarbonate to be applied with the protective agent, to which a latent image is to be formed. The charging unit uniformly charges the photoconductor. The development unit develops the latent image formed on the photoconductor as a toner image using a developing agent including toner particles. The cleaning unit removes toner particles remaining on the surface of the photoconductor after the toner image is transferred to a transfer member. The application unit applies the protective agent to the surface of photoconductor. A C1s spectrum of the photoconductor, detected by X-ray photoelectron spectroscopy (XPS) analysis before and after applying the protective agent on the photoconductor, includes a plurality of peaks, corresponding to different carbon binding energy. One of the plurality of peaks in a binding energy range of 290.3 eV to 294 eV is used as target peak to determine a coating condition of the photoconductor coated by the protective agent. A peak area of the target peak with respect to a total area of C1s spectrum of the photoconductor is detected before and after applying the protective agent as a first peak area ratio $A_0$(%) and a second peak area ratio A(%) to determine a coating condition of the photoconductor, respectively. The first peak area ratio $A_0$(%) is detected as a value before applying the protective agent, and the photoconductor having the first peak area ratio $A_0$(%) of 3% or more is employed. The second peak area ratio A(%) is detected as a value after applying the protective agent. The photoconductor is applied with the protective having a coating ratio of 60% or more, computed by $(A_0-A)/A_0\times100$(%).

In another aspect of the present disclosure, a method of detecting a surface condition of a photoconductor for use in an image forming apparatus is employed when the photoconductor is coated with a protective agent having paraffin as a main component when used in the image forming apparatus. The method includes a) measuring, b) determining, c) determining, and d) computing. In a) measuring, a C1s spectrum of the photoconductor having polycarbonate is measured. In b) determining, a surface condition of the photoconductor before being applied with the protective agent is detected using a target range of binding energy of the photoconductor in the C1s spectrum. The surface condition of the photoconductor before being applied with the protective agent is determined as a first peak area ratio $A_0$(%) with respect to a total peak area of the C1s spectrum. The photoconductor having the first peak area ratio $A_0$(%) of 3% or more is employed and the target range of binding energy corresponds to a binding energy of the polycarbonate. In c) determining, a surface condition of the photoconductor after being applied with the protective agent is detected using the target range of binding energy of the photoconductor in the C1s spectrum as a second peak area ratio A(%) with respect to a total peak area of the C1s spectrum. In d) computing, a coating ratio of the photoconductor coated by the protective agent is computed as $(A_0-A)/A_0\times100$(%).

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 8 shows results of experiment of a process cartridge, in which evaluation result is classified in three levels.

Figure 1:
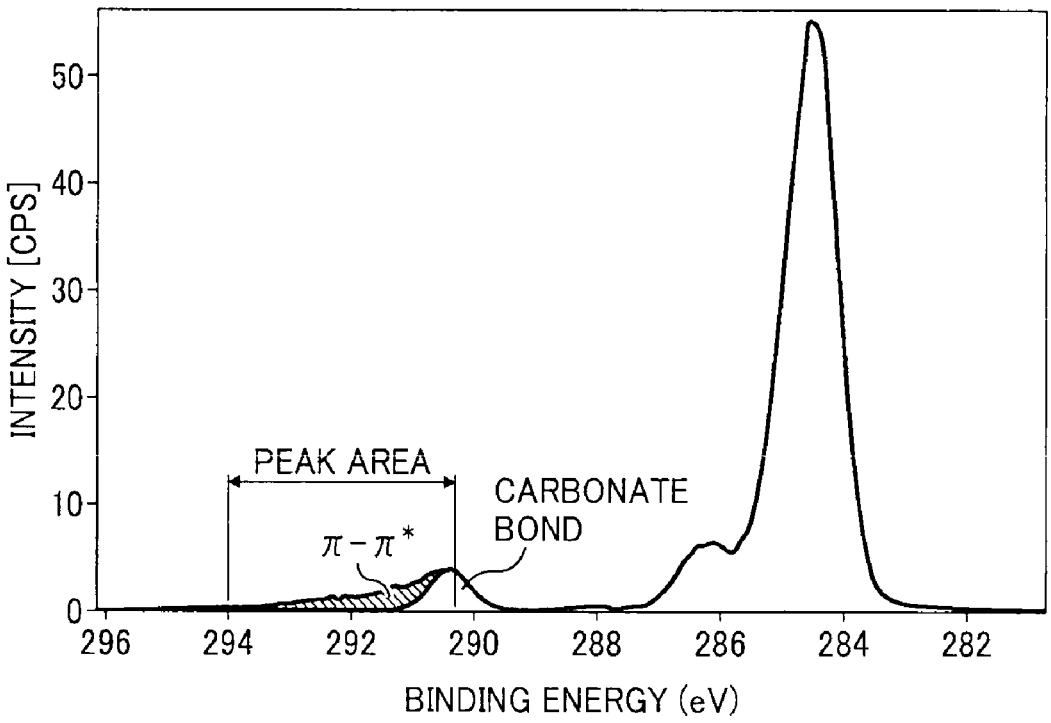
FIG. 1 shows an intensity profile of binding energy for a surface of a photoconductor drum before applying a protective agent, the binding energy is detected by XPS.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to accompanying drawings. The image forming apparatus may employ electrophotography, for example, but not limited thereto.

Hereinafter, a photoconductor used in a process cartridge is explained at first, and then an image forming apparatus using such photoconductor is explained.

In an exemplary embodiment, a protective agent, having no metal component, such as paraffin, is applied to a photoconductor, and an amount of the applied protective agent is determined not by detecting component included in the protective agent but by detecting a component included only in the photoconductor. Hereinafter, such component included only in the photoconductor may be referred as "target component" for the simplicity of expression in this disclosure. In an exemplary embodiment, the amount of protective agent, having no metal component, applied to a photoconductor is determined by using an index value attributed to "target component", to be described later.

When a protective agent is applied to the photoconductor, the protective agent coats the photoconductor. Accordingly, the greater the amount of protective agent applied or coated on the photoconductor, the smaller the detection value of the "target component" of the photoconductor. In this disclosure, an analysis and its result for tracing or detecting the "target component" included only in the photoconductor are described.

Based on experiment results, to be described later, as for a photoconductor including polycarbonate resin, it was found that a peak attributed to polycarbonate detected in a range of 290.3 eV to 294 eV in the C1s spectrum can be used to evaluate a surface condition of a photoconductor before and after applying a protective agent. Specifically, such peak attributed to polycarbonate is detected before applying a protective agent (or before using a photoconductor for an image forming operation) and after applying a protective agent. After applying the protective agent on the photoconductor, a peak value in the same energy range became a smaller intensity value compared to before applying a protective agent, or such peak was not detected.

In an exemplary embodiment, a surface condition of photoconductor is analyzed based on a spectrum analysis as below. Before applying a protective agent to a photoconductor, the C1s spectrum of the photoconductor is obtained by XPS analysis. The C1s spectrum profile includes a plurality of peaks, corresponding to different carbon bonding conditions such as binding energy. Accordingly, each of peaks in one spectrum profile indicates different carbon bonding conditions.

In an exemplary embodiment, the C1s spectrum has one peak area in a range of 290.3 eV to 294 eV, and such peak area (hereinafter, target peak area) is computed before and after applying a protective agent. Such target peak area is determined as a ratio with respect to a total area of the C1s spectrum of the photoconductor. Specifically, a target peak area ratio before applying protective agent is referred as first area value "$A_0$," and a target peak area ratio after applying protective agent is referred as second area value "A" for the simplicity of expression. In this disclosure, a ratio of the first area value "$A_0$" and the second area value "A" is determined to evaluate a coating condition of a photoconductor.

As above described, when a protective agent is applied to the photoconductor, the photoconductor is coated by the protective agent, by which the second area value "A" becomes smaller than the first area value "$A_0$." Such second area value "A" and first area value "$A_0$" are compared each other to evaluate a coating condition of the photoconductor.

As described later, it was found that when the second area value "A" becomes smaller than a given value, the photoconductor can be effectively and reliably coated with a protective agent, and such photoconductor can be preferably used for enhancing durability of an image forming apparatus.

In this disclosure, a peak means a curve profile shown by Gaussian function curve or Lorenz function curve, and a peak top means a top of the curve profile. Such curve profile may not be limited to Gaussian curve or Lorenz curve, but a combination of Gaussian curve and Lorenz curve, and other suitable function curve can be used.

A peak value obtained in a range of 290.3 eV to 294 eV is attributed to a carbonate bonding in polycarbonate resin, and $\pi$-$\pi^*$ electron transition of CTM (charge transport material) in the photoconductor and benzene ring in the polycarbonate resin.

As above described, a reduction or disappearance of peak value in a range of 290.3 eV to 294 eV may occur when a protective agent, such as paraffin, is applied and coated on a surface of photoconductor because such coated photoconductor may reduce a surface portion not coated by the protective agent (i.e., exposed surface portion of the photoconductor is reduced).

Accordingly, a ratio of an exposed surface of the photoconductor can be determined based on a ratio of the aforementioned second area value "A" in a range of 290.3 eV to 294 eV (i.e., a value after applying protective agent) with respect to a total area of C1s spectrum. Specifically, the second area value "A" becomes smaller and smaller when more and more protective agent is applied to the photoconductor. Accordingly, the smaller the ratio of second area value "A" with respect to the total area of C1s spectrum, the smaller the exposed surface portion of the photoconductor.

With such detection method used for determining a surface condition of a photoconductor coated with a protective agent having no metal component, an exposed surface ratio of the photoconductor (or a coating ratio of the photoconductor) can be measured. Accordingly, a surface condition of a photoconductor coated with the protective agent can be determined even if the protective agent does not include a metal component. When a photoconductor is coated with a protective agent including metal component, a surface condition of the photoconductor can be detected by known detection methods as above described. Accordingly, by using the detection method according to an exemplary embodiment in addition to known detection methods used for a protective agent including a metal component, a surface condition of a photoconductor coated with a protective agent can be determined without a limitation on types of protective agents, which is preferable for evaluating a surface condition of a photoconductor used for an image forming apparatus.

Figure 2A:
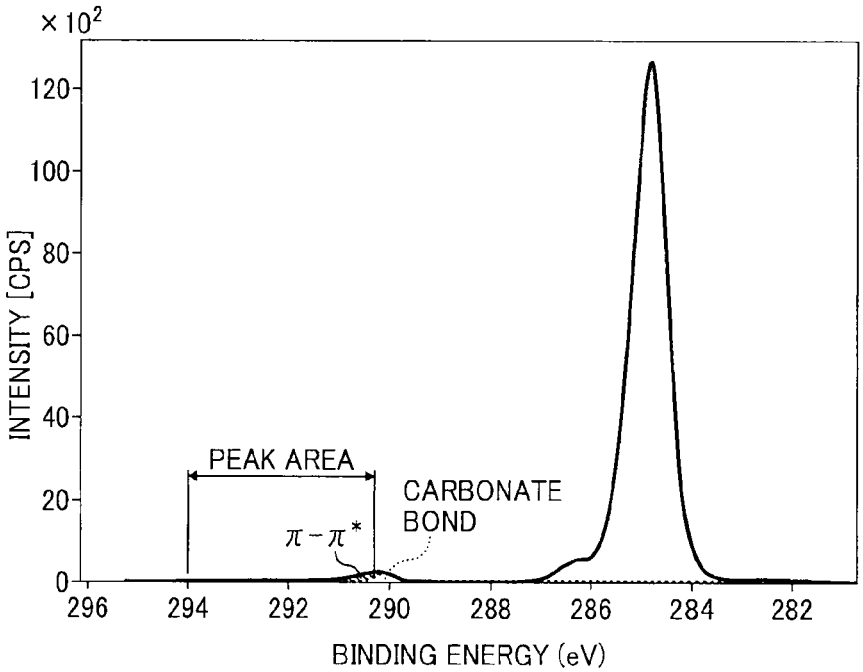
FIGS. 2A and 2B show intensity profiles of binding energy for a surface of a photoconductor drum after applying a protective agent, the binding energy is detected by XPS.
Figure 2B:
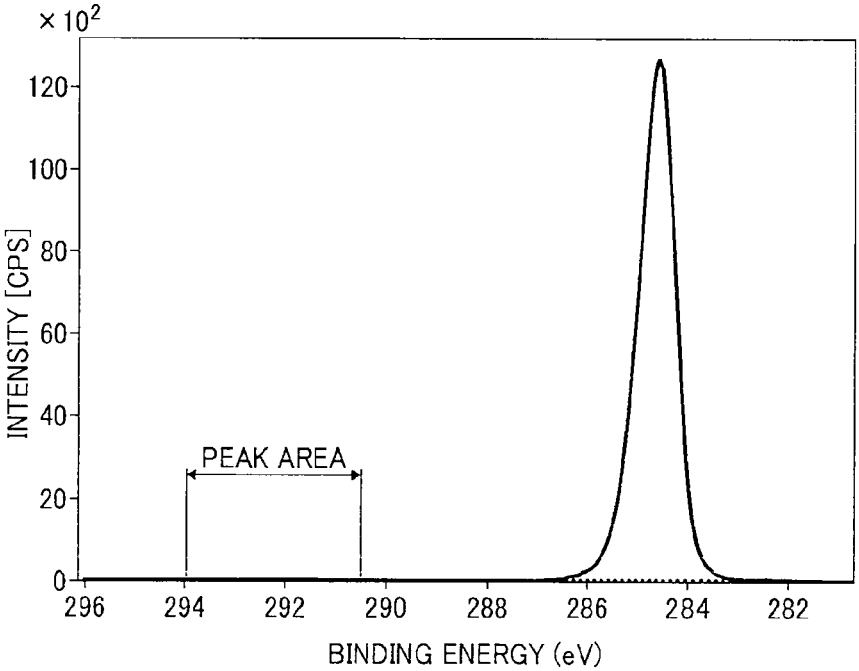

FIGS. 1 and 2 show example intensity profiles of binding energy for a surface of a photoconductor before or after applying a protective agent, detected by XPS analysis. FIG. 1 shows an intensity profile of binding energy for a surface of a photoconductor before applying a protective agent, and FIG. 2 shows an intensity profile of binding energy for a surface of a photoconductor after applying a protective agent. FIG. 2A shows an intensity profile of binding energy for a surface of a photoconductor applied with a protective agent at a coating ratio of 74%, and FIG. 2B shows an intensity profile of binding energy for a surface of a photoconductor applied with a protective agent at a coating ratio of 98%. Hereinafter, a method of computing the aforementioned $A_0$ and A is explained with reference to FIGS. 1 and 2.

First, with reference to FIG. 1, a method of computing the first area value "$A_0$" from the C1s spectrum before applying a protective agent is explained. Then, with reference to FIG. 2, a method of computing the second area value "A" from the C1s spectrum after applying a protective agent is explained. In this disclosure, the C1s spectrum means a spectrum of binding energy ranging from 281 eV to 296 eV shown in FIG. 1. The C1s means "1s orbit of carbon (C1s orbit)." Accordingly, the C1s spectrum is a photoelectron spectrum, which is obtained by irradiating an X ray to a sample and detecting photoelectron emitted from the 1s orbit of carbon (C1s orbit). A total area of the C1s spectrum can be obtained by separating peaks included in the C1s spectrum, determining each area of each peak, and then adding values of each area of each peak, or can be obtained by computing the C1s spectrum as one area. From a viewpoint of saving a process of separating peaks in the C1s spectrum and obtaining a higher precision value, a total area of the C1s spectrum can be preferably obtained by computing the C1s spectrum as one area. Hereinafter, the total area of the C1s spectrum before applying protective agent, computed by the aforementioned methods, is referred as non-applied total area "$Y_0$."

As shown in FIG. 1, a peak detected in a range of 290.3 eV to 294 eV, which is used for computing the first area value $A_0$, can be separated in two peaks: one peak is attributed to carbonate bonding (area next to shaded area in FIG. 1), and the other peak is attributed to the aforementioned π-π* transition (shaded area in FIG. 1). The other peak attributed to π-π* transition includes a plurality of peaks, superimposed one another. Accordingly, a peak area detected in a range of 290.3 eV to 294 eV can be computed by separating a plurality of peaks into each peak, determining a peak area of each peak, and adding the peak area value of each peak. Such peak area before applying a protective agent is referred as non-applied target area "$W_0$."

If a peak in a range of 290.3 eV to 294 eV is not superimposed with a peak having a binding energy of 290.3 eV or less and a peak having a binding energy of 294 eV or more as shown in FIG. 1, the non-applied target area $W_0$ in a range of 290.3 eV to 294 eV can be computed as one area without separating a profile into a plurality of peak profiles. When the non-applied total area $Y_0$ and non-applied target area $W_0$ is computed, the first area value $A_0$ can be computed with a following equation.

$$A_0=(W_0/Y_0)\times 100$$

In case of an example profile shown in FIG. 1, the first area value $A_0$ has a value of 8.7% ($A_0$=8.7%), for example.

Similarly, a computation of the second area value "A" after applying a protective agent is described using the C1s spectrum shown in FIG. 2. As above described, the C1s spectrum means a spectrum ranging from 281 eV to 296 eV. As similar to the computing method for the $Y_0$, a total area of the C1s spectrum after applying a protective agent is obtained by separating peaks included in the C1s spectrum, determining each area of each peak, and then adding values of each area of each peak, or obtained by computing the C1s spectrum as one area. From a viewpoint of saving a process of separating peaks in the C1s spectrum and obtaining a higher precision value, a total area of the C1s spectrum can be preferably obtained by computing the C1s spectrum as one area. Hereinafter, the total area of the C1s spectrum after applying protective agent, computed by the aforementioned method, is referred as applied total area "Y."

Further, as similar to the computing method for the first area value $A_0$, the second area value "A" is computed as below. A peak detected in a range of 290.3 eV to 294 eV, which is used for computing the second area value A, can be separated in two peaks: one peak is attributed to carbonate bonding (area next to shaded area in FIG. 2), and the other peak is attributed to π-π* transition (shaded area in FIG. 2). The other peak attributed to the aforementioned π-π* transition includes a plurality of peaks, superimposed one another. Accordingly, a peak area detected in a range of 290.3 eV to 294 eV can be computed by separating a plurality of peaks into each peak, determining a peak area of each peak, and adding the peak area value of each peak. Such peak area after applying protective agent is referred as applied target area "W."

If a peak in a range of 290.3 eV to 294 eV is not superimposed with a peak having a binding energy of 290.3 eV or less and a peak having a binding energy of 294 eV or more as shown in FIG. 2, the applied target area W in a range of 290.3 eV to 294 eV can be computed as one area without separating a profile into a plurality of peak profiles. When the applied total area Y and applied target area W are computed, the second area value A can be computed with a following equation.

$$A=(W/Y)\times 100$$

Based on the computed first area value $A_0$ and the second area value A, a coating ratio of a photoconductor can be obtained by a following equation.

$$((A_0-A)/A_0)\times 100(\%)$$

In case of an example profile shown in FIG. 2A, the second area value "A" has a value of 2.3% (A=2.3%), and in case of an example profile shown in FIG. 2B, the second area value "A" has a value of 0.2% (A=0.2%). Accordingly, the coating ratio of the photoconductor in FIGS. 2A and 2B respectively becomes 74% and 98% using the above equation because the first area value $A_0$ in FIGS. 2A and 2B is 8.7% as above described.

In an exemplary embodiment, a coating ratio, defined by $((A_0-A)/A_0\times100)(\%)$, for a process cartridge may be preferably set to 60% or more, more preferably 65% or more, and further preferably 70% or more. If the coating ratio is too small, damages caused on a photoconductor by charging process may not be effectively suppressed, which is not preferable. Such coating ratio is preferably determined by experiments, to be described later in this disclosure.

In an exemplary embodiment, a ratio of metal component in a protective agent may be preferably 0.1% or less, and more preferably 0.05% or less. Although a protective agent according to an exemplary embodiment can include a metal component, such protective agent including a metal component can be easily detected by known methods, such as XPS, for detecting intensity of peak attributed to a metal component before and after applying a protective agent compared to a method separating a profile of C1s spectrum and tracing or detecting a peak in a range of 290.3 eV to 294 eV, described in this disclosure. Further, when a protective agent including a metal component is used, a peak value attributed to a metal component can be traced or detected by IR (infrared) or ICP (inductively-coupled plasma) analysis other than XPS, which are easier to conduct. Accordingly, in case of using a protective agent including a metal component, a coating ratio of protective agent can be computed without using a method according to an exemplary embodiment, which traces or detects a peak in a range of 290.3 eV to 294 eV by separating a profile of C1s spectrum. In other words, the method according to an exemplary embodiment is preferably used to determine a surface condition coated with a protective agent not including a metal component.

In a process cartridge according to an exemplary embodiment, a charging unit may use a charge roller, which may employ an AC charging method, in which a direct-current voltage is superimposed to an alternating-current voltage to charge a photoconductor. When such AC charging process is conducted, the coating ratio, defined by $((A_0-A)/A_0\times100\%)$, may be set to 70% or more, more preferably 75% or more, and further preferably 80% or more. If the coating ratio is too small when such AC charging method is used, damages may occur on a photoconductor by a charging process, and the photoconductor may not be effectively protected, which is not preferable.

In an exemplary embodiment, a photoconductor used in a process cartridge preferably has the first area value $A_0$ of 3% or more. If the first area value $A_0$ of the photoconductor becomes too small, a detection error of $A_0$ and A may affect the value computed by the equation of $(A_0-A)/A_0\times100(\%)$, by which a coating ratio of the photoconductor cannot be computed reliably, which is not desirable because a process cartridge having a preferable condition cannot be prepared if the surface condition of the process cartridge is not reliably determined.

A photoconductor according to an exemplary embodiment may be set in an image forming apparatus when shipped from a factory or the like so that the photoconductor can be already applied with a protective agent before the image forming apparatus is used at a user location. Accordingly, it is in need to confirm that a coating ratio of protective agent on the photoconductor defined by $((A_0-A)/A_0\times100)$ (%) is set to the above described value, such as 60% or more, before shipping an image forming apparatus from a factory. The photoconductor according to an exemplary embodiment may be shipped from a factory by assembling the photoconductor in a process cartridge, by assembling the photoconductor in an image forming apparatus, or as a replacement unit, for example.

Practically, the above-described coating ratio measurement process needs breaking of a photoconductor physically, and thereby the photoconductor used for measuring the coating ratio cannot be assembled in a process cartridge. Accordingly, preferably, one or more sample photoconductors may be selected among photoconductors coated with a protective agent by a same application method to measure a coating ratio on photoconductors to confirm that a coating ratio of photoconductors can be set to a given value or range according to an exemplary embodiment.

A protective agent may be preferably applied to a photoconductor in advance by contacting a blade on a surface of photoconductor while supplying the protective agent on the surface of photoconductor, in which the protective agent may be supplied on the photoconductor by directly pressing powdered-protective agent on the photoconductor, or by supplying a protective agent using a brush roller, which can scrape a block-shaped protective agent and supply such scraped protective agent onto the photoconductor, for example. Further, if a photoconductor is heated at a temperature about a melting point of the protective agent, such protective agent can be melted on a surface of the photoconductor with a shorter time, by which the surface of photoconductor can be coated with the protective agent in a shorter time, which is preferable from a viewpoint of forming a layer of protective agent efficiently.

In an exemplary embodiment, a protective agent includes paraffin with 50 wt % (weight percent) or more, more preferably 60 wt % or more, and further preferably 70 wt % or more, for example. If the paraffin amount included in the protective agent is too small, a photoconductor may not be effectively protected by the protective agent, which is not preferable. Such paraffin includes normal paraffin, isoparaffin, and cyclo paraffin, for example, which may be a chemically stable material such as less-likely-to-occur addition reaction and less-likely-to-occur oxidation reaction in the atmosphere. Accordingly, paraffin can be preferably used as a protective agent from a viewpoint of material stability over time. Other than paraffin, a protective agent may include cyclic olefin copolymer (COC), and amphiphilic organic compound, for example. Such amphiphilic organic compound may be anionic surfactant, cationic surfactant, zwitterionic surfactant, nonionic surfactant, or a complex compound of these, for example.

The nonionic surfactant may preferably be an ester compound of alkylcarboxylic acid (see chemical formula (1)) and polyalcohol.

$$C_nH_{2n+1}COOH \qquad \text{(chemical formula (1))},$$

in which "n" is an integral number from 15 to 35.

If a straight chain alkylcarboxylic acid is used as alkylcarboxylic acid, amphiphilic organic compound can be preferably adhered on a surface of an image carrying member such as photoconductor. Specifically, hydrophobicity portion of the amphiphilic organic compound can be oriented to a surface of an image carrying member in an orderly manner, and thereby the amphiphilic organic compound can be preferably adsorbed on the image carrying with a higher adsorption density.

Alkylcarboxylic acid ester has hydrophobicity. The greater the number of alkylcarboxylic acid ester in one molecule, the more effective to suppress an adsorption of dissociated material generated by aerial discharge to a surface of an image carrying member such as photoconductor, and the more effective to reduce a electrical stress to a surface of the image carrying member during a charging process. However, if a ratio of alkylcarboxylic acid ester becomes too great, polyalcohol having hydrophilicity may be blocked by the alkylcarboxylic acid ester, by which an adsorption performance may not be effectively obtained depending on a surface condition of an image carrying member. Accordingly, the average number of ester bond in one molecule of amphiphilic organic compound may be preferably from 1 to 3. Such average number of ester bond in one molecule of amphiphilic organic compound can be set or adjusted by selecting one amphiphilic organic compound or by mixing a plurality of amphiphilic organic compounds, each compound having different number of ester bonds. Such amphiphilic organic compound may include anionic surfactant, cationic surfactant, zwitterionic surfactant, and nonionic surfactant, as above described.

Examples of the anionic surfactant include compounds of alkali metal ion (e.g., sodium, potassium), alkaline-earth metal ion (e.g., magnesium, calcium), metal ion (e.g., aluminum, zinc), or ammonium ion bonded with a compound having an anion at hydrophobicity portion, such as alkyl benzene sulfonate, α-olefin sulfonate, alkane sulfonate, sulfuric alkyl salt, sulfuric alkylpolyoxyethylene salt, alkyl phosphate salt, long-chain aliphatic acid salt, α-sulfoaliphatic acid ester salt, and alkyl ether sulfate.

Examples of the cationic surfactant include compounds composed of chlorine, fluorine, bromine, phosphoric ion, nitrate ion, sulphuric ion, thiosulphuric ion, carbonate ion, and hydroxide ion, which are bonded to a compound having a cation at hydrophobicity portion, such as alkyltrimethyl ammonium salt, dialkylmethyl ammonium salt, and alkyldimethylbenzyl ammonium salt.

Examples of the zwitterionic surfactant include dimethylalkylamine oxide, N-alkylbetaine, imidazoline derivatives, and alkylamino acid.

Examples of the nonionic surfactant include alcohol compound, ether compound, or amide compound, such as long-chain alkylalcohol, alkylpolyoxyethylene ether, polyoxyethylene alkyl phenyl ether, aliphatic acid diethanolamide, alkyl polyglucoxide, and polyoxyethylene sorbitan alkylester. Further, examples of the nonionic surfactant preferably include long-chain alkylcarboxylic acid, such as lauric acid, paltimic acid, stearic acid, behenic acid, lignoceric acid, cerinic acid, montanic acid, melissic acid; polyalcohol, such as ethylene glycol, propylene glycol, glycerin, erythritol, hexitol; and ester compound having partially anhydride compound of these.

Examples of ester compounds include alkylcarboxylic acid glyceryl or its substitution, such as monoglyceryl stearate, diglyceryl stearate, monoglyceryl palmitate, diglyceryl laurate, triglyceryl laurate, diglyceryl palmitate, triglyceryl palmitate, diglyceryl myristate, triglyceryl myristate, glyceryl palmitate/stearate, monoglyceryl arachidate, diglyceryl arachidate, monoglyceryl behenate, glyceryl stearate/behenate, glyceryl cerinate/stearate, monoglyceryl montanate, monoglyceryl melissate; and alkylcarboxylic acid sorbitan or its substitution, such as monosorbitan stearate, trisorbitan stearate, monosorbitan palmitate, disorbitan palmitate, trisorbitan palmitate, disorbitan myristate, trisorbitan myristate, sorbitan paltimate/stearate, monosorbitan arachidate, disorbitan arachidate, monosorbitan behenate, sorbitan stearate/behenate, sorbitan cerinate/stearate, monosorbitan montanate, monosorbitan melissate, but not limited those. These amphiphilic organic compound can be used alone or in combinaton.

Further, a protective agent may include fine particles of inorganic compound dispersed therein to facilitate a supply of protective agent to a photoconductor. Examples of the inorganic compound include alumina, silica, tin oxide, potassium titanate, titanium oxide, titanium nitride, zinc oxide, indium oxide, antimony oxide, boron nitride, and talc.

As above-described, the C1s spectrum profile, detected by analyzing a surface of photoconductor coated with a protective agent according to an exemplary embodiment using an XPS analysis, is composed of a plurality of peaks, corresponding to different carbon-to-carbon bonding conditions, and different peaks are separated to evaluate each peak having different binding energies.

Further, a protective agent may include a component, which can be detected as a peak area in a range of 290.3 eV to 294 eV of the C1s spectrum profile. Such peak area attributed to the protective agent may be preferably set 1% or less with respect to a total area of the C1s spectrum. If the peak area attributed to the protective agent becomes greater, such as 1% or more, with respect to a total area of the C1s spectrum, such peak are attributed to protective agent may be observed in a range of 290.3 eV to 294 eV even if the protective agent coats an entire surface of a photoconductor.

Although such protective-agent attributed peak area may not affect a coating ratio computing, it is preferable that such agent attributed area may not be detected or may have too little value in a range of 290.3 eV to 294 eV so that a coating ratio computing can be conducted easily.

Especially, if such agent-attributed area may take a value which is too close to the aforementioned first area value $A_0$(%) on the photoconductor, the value of $A_0$(%) or A(%) detected before and after applying the protective agent may not change so greatly, by which a coating ratio may not be reliably determined by the coating ratio computing method according to an exemplary embodiment.

Further, if a protective agent includes CF2 (one carbon atom attached with two fluorine atoms) or CF3 (one carbon atom attached with three fluorine atoms) group, peaks attributed to CF2 and CF3 may be observed in a range of 290.3 eV to 294 eV. Accordingly, if such protective agent is used, CF2/CF3 attributed peaks may need be to be considered to evaluate a spectrum profile of a photoconductor.

A description is now given to a photoconductor preferably used in an exemplary embodiment. The photoconductor used in an image forming apparatus is composed of a conductive support and a photosensitive layer provided thereon. A surface of photosensitive layer of the photoconductor includes polycarbonate component. The photosensitive layer may be of a monolayer type in which a charge generation material and a charge transport material are mixed, or a forward lamination type in which a charge transport layer is provided on a charge generation layer, or a reverse lamination type in which a charge generation layer is provided on a charge transport layer. Further, a surface protective layer may be provided on the photosensitive layer to enhance physical strength, anti-abrasiveness, anti-gas property, cleaning performance and the like of the photoconductor. Further, a backing layer may be provided between the photosensitive layer and the conductive support. Further, each layer may be added with an appropriate amount of plasticizer, antioxidant, leveling agent and the like as necessary.

The conductive support of the photoconductor may have a drum shape prepared as below, for example. A cylindrically shaped plastic/paper is covered with a metal compound by vapor deposition or spattering to form the conductive support. The metal compound may be aluminum, nickel, chromium, nichrome, copper, gold, silver, or platinum, or metal oxide, such as tin oxide or indium oxide, having conductivity of volume resistance of equal to or less than $10^{10}$ Ωcm. Alternatively, a metal plate, such as aluminum, aluminum alloy, nickel, stainless, or a tube obtained by extruding or drawing the metal plate, is subjected to surface treatment such as grinding, super-finishing, polishing and the like to form the conductive support. As the drum-like support, those having a diameter ranging from 20 mm to 150 mm, preferably from 24 mm to 100 mm, more preferably from 28 mm to 70 mm can be used. Diameter of drum-like support of equal to or less than 20 mm is not preferable because arrangement of a charging device, a light exposure device, a development device, a transfer device, and a cleaning device around the drum is physically difficult, and diameter of drum-like support of equal to or more than 150 mm is not preferable because the size of image forming apparatus increases. When the image forming apparatus is of tandem type, in particular, the diameter is equal to or less than 70 mm, and preferably equal to or less than 60 mm because a plurality of photoconductors should be disposed. Also known conductive endless belts, such as nickel belt or stainless belt, may be used as a conductive support.

The backing layer of photoconductor for use in an exemplary embodiment may be a resin layer, a resin layer having white pigment, or a metal oxide layer obtainable by chemically or electrochemically oxidizing surface of conductive base, for example, and the resin layer having white pigment is preferred. Examples of the white pigment include metal oxide, such as titanium oxide, aluminum oxide, zirconium oxide, and zinc oxide, and among these, it is preferred to contain titanium oxide having excellent ability to prevent charges from being injected from the conductive base. Examples of the resin used in the backing layer include thermoplastic resin, such as polyamide, polyvinyl alcohol, casein, methyl cellulose; thermosetting resin, such as acryl, phenol, melamine, alkyd, unsaturated polyester, epoxy; and mixtures of one or many of these.

Examples of the charge generation substance of photoconductor for use in an exemplary embodiment include organic pigments and dyes, such as azo pigments (e.g., monoazo pigments, bisazo pigments, trisazo pigments, tetrakisazo pigments), triarylmethane dyes, thiazine dyes, oxazine dyes, xanthene dyes, cyanine dyestuffs, styryl dyestuffs, pyrylium dyes, quinacridone dyes, indigo dyes, perylene pigments, polycyclic quinone pigments, bisbenzimidazole pigments, indathrone pigments, squarylium pigments, phthalocyanine pigments; and inorganic materials, such as serene, serene-arsenic, serene-tellurium, cadmium sulfide, zinc oxide, titanium oxide and amorphous silicon, and the charge generation substance may be used singly or in combination of plural kinds. The backing layer of photoconductor may be composed of one layer or a plurality of layers.

Examples of the charge transport substance of photoconductor for use in an exemplary embodiment include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, triphenylmethane derivatives, and these may be used singly or in combination of plural kinds.

The binding resin used for forming the photosensitive layer of charge generation layer and charge transport layer include known thermoplastic resins, thermosetting resins, photosetting resins, and photoconductive resins having electric insulation. Examples of binding resin include thermoplastic resin, such as polyvinyl chloride, polyvinylidene chloride, vinyl chloride-vinyl acetate copolymer, vinyl chloride-vinyl acetate-maleic anhydride copolymdr, ethylene-vinyl acetate copolymer, polyvinyl butyral, polyvinyl acetal, polyester, phenoxy resin, (meth)acryl resin, polystyrene, polycarbonate, polyacrylate, polysulfone, polyethersulfone and ABS resin; thermosetting resin, such as phenol resin, epoxy resin, urethane resin, melamine resin, isocyanate resin, alkyd resin, silicone resin and thermosetting acryl resin; and photoconductive resin, such as polyvinyl carbazole, polyvinyl anthracene and polyvinylpyrene. These can be used alone or a mixture of plural kinds of binding resins can be used, but are not limited thereto. However, if the charge generation layer or charge transport layer is used as a top surface layer, the binding resin may use polycarbonate resin having a transparency to a light beam used for writing an image and a good level of insulation performance, physical strength, and adhesiveness.

As the antioxidant, those listed below may be used, for example.

Monophenol compound: 2,6-di-t-butyl-p-cresol, butylated hydroxy anisole, 2,6-di-t-butyl-4-ethylphenol, stearyl-β-(3,5-di-t-butyl-4-hydroxyphenyl)propionate, 3-t-butyl-4-hydroxyanisole or the like.

Bisphenol compound: 2,2'-methylene-biS-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) or the like.

Polymeric phenol compound: 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocopherols, or the like.

p-phenylenediamine: N-phenyl-N'-isopropyl-p-phenylene diamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, or the like.

Hydroquinone: 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone or the like.

Organic sulfur compound: Dilauryl-3,3'-thiodipropionate, distearyl-3,3'-thiodipropionate, ditetradecyl-3,3'-thiodipropionate, or the like.

Organic phosphor compound: Triphenyl phosphine, tri(nonylphenyl)phosphine, tri(dinonylphenyl)phosphine, tricresyl phosphine, tri(2,4-dibutylphenoxy)phosphine, or the like.

As the plasticizer, resin, such as dibutylphthalate and dioctylphthalate that is commonly used as a plasticizer, may be used, and an appropriate use amount is about 0 to 30 parts by weight, relative to 100 parts by weight of the binding resin.

Further, a leveling agent may be added to the charge transport layer. As the leveling agent, silicone oil, such as dimethyl silicone oil, methylphenyl silicone oil, and polymer or oligomer having perfluoroalkyl group as a side chain can be used, for example, and an appropriate use amount is about 0 to 1 part by weight, relative to 100 parts by weight of binding resin.

The surface layer of photoconductor is provided for improving or enhancing physical strength, abrasion resistance (or anti-abrasiveness), gas resistance (or anti-gas property), cleanability (or cleaning performance) of a photoconductor. As the surface layer, those of polymer having higher physical strength than the photosensitive layer, and those of polymer in which inorganic fillers are dispersed can be exemplified. The polymer used for the surface layer may be any polymers including thermoplastic polymers and thermosetting polymers, and thermosetting polymers are particularly preferred because they have high physical strength and a good ability of suppressing abrasion, which may occur when frictioned with a cleaning blade. The surface layer may not need to have charge transport ability insofar as it has a smaller film thickness. However, when a thicker surface layer not having charge transport ability is formed, a photoconductor may decrease its photosensitivity, increase its post-exposure potential, and increase its residual potential. Therefore, it is preferred to contain the charge transport substance in the surface layer or to use polymer having charge transport ability for the surface layer. In general, the photosensitive layer and the surface layer have physical strength, which are greatly different each other. When the surface layer is abraded and disappeared due to friction with a cleaning blade, the photosensitive layer will be also abraded in soon. Therefore, when providing a surface layer, the surface layer has a sufficient film thickness, ranging from 0.01 μm (micrometer) to 12 μm, preferably ranging from 1 μm to 10 μm, and more preferably from 2 μm to 8 μm. Film thickness of surface layer of equal to or less than 0.1 μm is not preferred because it is so thin that partial disappearance is likely to occur due to friction with a cleaning blade, and abrasion of photosensitive layer proceeds from the disappeared part. Film thickness of surface layer of equal to or more than 12 μm is not preferred because such thicker surface layer may decrease photosensitivity, increase post-exposure potential, and increase residual potential for a photoconductor, and if polymer having charge transport ability and relatively high price is used for surface layer, a cost of photoconductor becomes higher, which is not preferable.

As the polymer used in the surface layer, polycarbonate resin having transparency to a light beam at the time of an image writing, excellent insulation, physical strength, and adhesiveness is preferred. Such polymer may also include other resin, such as ABS (Acrylonitrile Butadiene Styrene) resin, ACS (Acrylonitrile Chlorinated polyethylene Styrene) resin, olefin-vinyl monomer copolymer, chlorinated polyether, allyl resin, phenol resin, polyacetal, polyamide, polyamidoimide, polyacrylate, polyallylsulfone, polybutylene, polybutyleneterephthalate, polycarbonate, polyethersulfone, polyethylene, polyethyleneterephthalate, polyimide, acryl resin, polymethylpentene, polypropylene, polyphenyleneoxide, polysulfone, polystyrene, AS resin, butadiene-styrene copolymer, polyurethane, polyvinyl chloride, polyvinylidene chloride, and epoxy, for example. These polymers may be thermoplastic polymer, and further, thermoplastic polymer may be converted into thermosetting polymer by cross-linking using a cross-linking agent having a multi-functional acryloyl group, carboxyl group, hydroxyl group, amino group or the like for enhancing physical strength of polymer. If such thermosetting polymer may be used for a surface layer, the physical strength of the surface layer can be enhanced, by which the abrasion of the surface layer, caused by friction with a cleaning blade, can be suppressed.

To enhance a physical strength of a surface layer, the surface layer may be dispersed with fine powders of metal component, metal oxide, or the like. Examples of the metal oxide include tin oxide, potassium titanate, titanium oxide, zinc oxide, indium oxide, and antimony oxide. Further, to enhance an anti-abrasiveness of a surface layer, the surface layer may be added with fluorocarbon resin, such as polytetrafluoroethylene, silicone resin, or compounds of these resins having dispersed inorganic materials, for example.

Hereinafter, a process cartridge according to an exemplary embodiment is explained with reference to FIG. 3.

A process cartridge according to an exemplary embodiment includes the above described photoconductor applied with a protective agent, a charging unit for uniformly charging the photoconductor, a developing unit for developing a latent image formed on the surface of photoconductor as toner image using a developing agent having toner, and an applicator used for applying the protective agent to the photoconductor.

Figure 3:
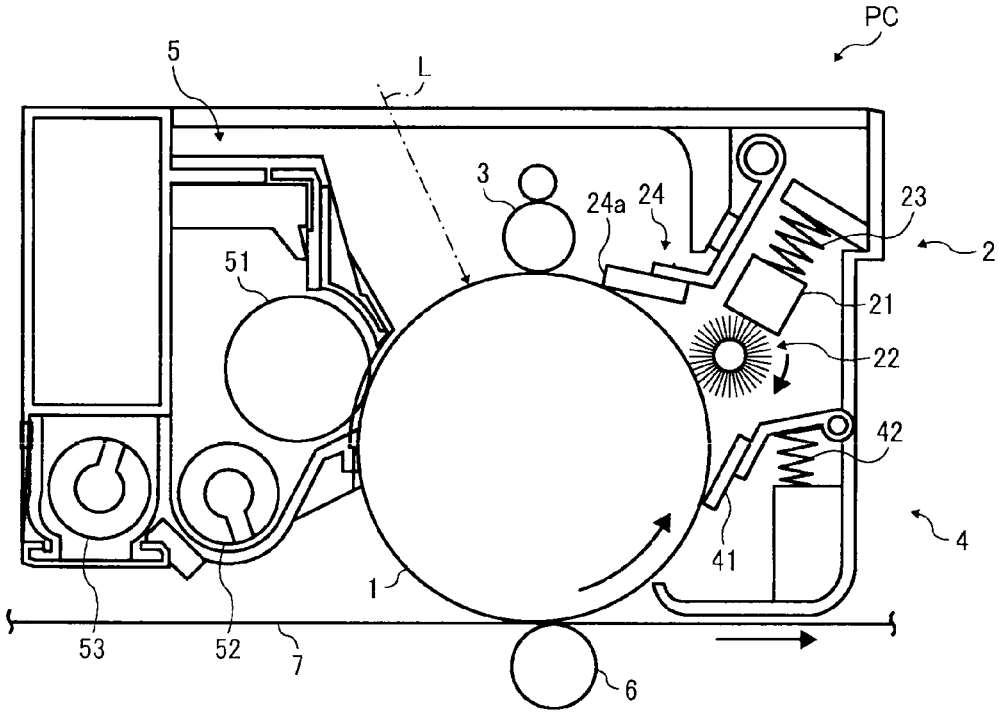
FIG. 3 illustrates a schematic cross-sectional view of a process cartridge having a protective layer setting unit according to an exemplary embodiment.

FIG. 3 illustrates a schematic configuration of a process cartridge according to an exemplary embodiment. A process cartridge PC includes a photoconductor drum 1, a protective layer setting unit 2, a charge roller 3, a cleaning unit 4, and a development unit 5, for example. Such process cartridge PC may be disposed proximity to a transfer roller 6 and a transfer member 7, such as transfer belt. The photoconductor drum 1 can be applied with a protective agent as above-described using the protective layer setting unit 2.

The protective layer setting unit 2 includes an agent bar 21, an agent applicator 22, a biasing force applicator 23, a layer adjusting unit 24 having a layer forming device 24*a*, for example. The agent bar 21 may be a block of protective agent, which may be made by melting and/or compressing a protective agent in a given shape such as bar shape. Such protective layer setting unit 2 can be used as an "application unit" for applying a protective agent onto the photoconductor drum 1. The cleaning unit 4 includes a cleaning member 41, and a biasing device 42, for example.

The process cartridge PC may conduct an image forming process as below. The photoconductor drum 1 is charged by the charge roller 3, and then a latent image is formed on photoconductor drum 1 by a light exposing process. The latent image is developed as toner image by the development unit 5. The toner image on the photoconductor drum 1 is transferred to the transfer member 7, and toner remaining on the photoconductor drum 1 is cleaned by the cleaning unit 4. After such cleaning process, the protective layer setting unit 2 applies a new protective agent on the photoconductor drum 1.

The charge roller 3 may use a direct current charging method or an AC charging method, but preferably use the AC charging method, which superimposes direct-current voltage on alternating-current voltage.

After conducting a transfer process, partially degraded protective agent or toner remaining on the surface of the photoconductor drum 1 can be cleaned by the cleaning member 41 of the cleaning unit 4. The cleaning member 41 may have a blade shape, for example. In FIG. 3, the cleaning member 41 is angled and contacted to the photoconductor drum 1 in a counter type configuration.

Although the layer adjusting unit 24 can be used as a cleaning member, both of the layer adjusting unit 24 and the cleaning member 41 are preferably disposed in the process cartridge PC as shown in FIG. 3 so as to form a thinner and uniform layer of protective agent on the photoconductor drum 1. In the protective layer setting unit 2, the agent applicator 22 applies a protective agent to a surface of the photoconductor drum 1, and the layer adjusting unit 24 is used to form a protective layer such as film-like layer on the photoconductor drum 1.

After forming the protective layer on the photoconductor drum 1, a latent image is formed on the photoconductor drum 1 by conducting a charging process and a light exposing process. The latent image is then developed by the development unit 5, and is transferred to the transfer member 7 by the transfer roller 6.

The agent bar 21 is contacted to the agent applicator 22 using a biasing force of the biasing force applicator 23, wherein the agent applicator 22 may be formed as brush roller, for example. The agent applicator 22, rotating at a given speed having a different linear velocity with respect to the photoconductor drum 1, slidably contacts the photoconductor drum 1 to apply the protective agent to the surface of the photoconductor drum 1, wherein the protective agent is held on surfaces of brushes of the brush roller.

Instead of using the agent bar 21, powders of protective agent can be directly supplied to a surface of the photoconductor drum 1. In this case, the agent bar 21, the agent applicator 22, and the biasing force applicator 23 can be omitted from the process cartridge PC, and a container for containing powders of protective agent and a powder transport unit for transporting protective agent powders are disposed for the process cartridge PC. The powder transport unit may be a known transport unit, such as pump, auger, or the like.

The protective agent supplied on a surface of the photoconductor drum 1 may not be formed as a uniform protective layer but may be formed as a non-uniform protective layer depending on types of protective agents. The layer forming device 24*a* of the layer adjusting unit 24 may be used to uniformly form a thinner protective layer on the surface of the photoconductor drum 1. The layer forming device 24*a* may be a blade, which contacts the photoconductor drum 1 in a trailing direction or counter direction with respect to a direction of rotation of the photoconductor drum 1. The layer forming device 24*a* may be fixed to a supporter provided in the layer adjusting unit 24. Hereinafter, the layer forming device 24*a* may be referred to blade 24*a*, and both terms may be used interchangeably.

Because a cleaning function of removing residual materials from a surface of the photoconductor drum 1 and a layer forming function of forming a protective layer on the photoconductor drum 1 may have some difference how to contact a member, such as blade, to the photoconductor drum 1, the cleaning unit 4 and the protective layer setting unit 2 may separately conduct different functions, for example. Specifically, the cleaning unit 4 having the cleaning member 41 and the biasing device 42 may be disposed at an upstream position of the protective layer setting unit 2 with respect to a direction of rotation of the photoconductor drum 1. Such configuration may preferably remove toner remaining on the photoconductor drum 1 before the protective layer setting unit 2 applies the protective agent on the photoconductor drum 1, in which the protective layer setting unit 2 may not be contaminated by the remaining toner on the photoconductor 1.

Figure 5:
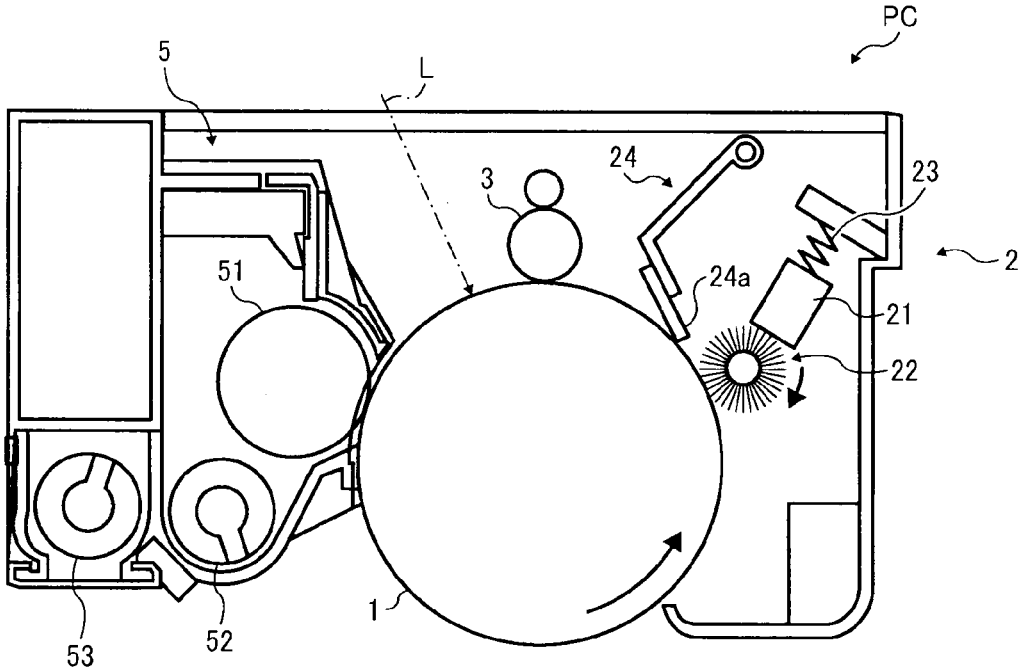
FIG. 5 illustrates a schematic cross-sectional view of another process cartridge according to another exemplary embodiment.

However, as described later in FIG. 5, a cleaning function for removing residual materials from a surface of the photoconductor drum 1 and a layer forming function for forming a protective layer on the photoconductor drum 1 may be integrated in one unit, in which the cleaning unit 4 can be omitted.

The layer forming device 24*a* (or blade 24*a*) may be made of a known elastic body, such as urethane rubber, hydrin rubber, silicone rubber, fluorocarbon rubber, or the like, which can be used alone or mixed. Such blade 24*a* may be coated with a material having a lower frictional coefficient to reduce friction at a contact portion with the photoconductor drum 1, wherein the blade 24*a* may be coated with such material by a dipping method or the like. Further, to adjust hardness of the elastic body, fillers such as organic filler or inorganic filler can be dispersed in the elastic body. Such blade 24*a* is fixed to a blade supporter using adhesive or fused directly to the blade supporter so that a leading edge of the blade 24*a* can be effectively contacted to the photoconductor drum 1 with a given pressure.

The blade 24*a* has a thickness of from 0.5 mm to 5 mm, and preferably from 1 mm to 3 mm, for example. If the thickness of the blade 24*a* is too thin, the blade 24*a* contacts the photoconductor drum 1 with too small force, by which the protective agent cannot be effectively extended on the photoconductor drum 1. If the thickness of the blade 24*a* is too thick, the blade 24*a* contacts the photoconductor drum 1 with too great force, by which the photoconductor drum 1 may be damaged and a greater torque may be required to rotate the photoconductor drum 1.

The blade 24*a* has a free length portion of from 1 mm to 15 mm, and preferably from 2 mm to 10 mm, for example. The free length portion is a flexibly bend-able portion, not attached to the blade supporter, which is determined based on a pressure force to be applied to the blade 24*a*. If the free length portion of the blade 24*a* is too small, the blade 24*a* cannot be fixed to the blade supporter, which is not preferable. If the free length portion of the blade 24*a* is too long, the blade 24*a* unstably contacts the photoconductor drum 1, by which the photoconductor drum 1 may not be cleaned effectively, which is not preferable.

Alternatively, the blade 24*a* can be made of a resilient metal and an elastic material formed on the resilient metal by a coating method or a dipping method using a coupling agent or a primer component. Further, a thermosetting process may be conducted for such blade 24*a* made of a resilient metal and an elastic material. Further, such blade 24*a* may be subjected to a surface polishing process. The resilient metal may be a sheet spring, and the elastic material may be resin, rubber, elastomer, or the like.

The resilient metal has a thickness of from 0.05 mm to 3 mm, and preferably from 0.1 mm to 1 mm, for example. If the thickness of the resilient metal is too thin, the blade 24*a* contacts the photoconductor drum 1 with too small force, by which the protective agent cannot be effectively extended on the photoconductor drum 1, which is not preferable. If the thickness of the resilient metal is too thick, the blade 24*a* contacts the photoconductor drum 1 with too great force, by which the photoconductor drum 1 may be damaged and a greater torque may be required to rotate the photoconductor drum 1, which is not preferable.

Further, the blade 24*a* made from the resilient metal may be bended in a direction parallel to a support direction after fixing the blade 24*a* to the blade supporter to prevent twisting of the blade 24*a*. The surface layer of the blade 24*a* may be fluorocarbon polymer, such as PFA (perfluoroalkoxy), PTFE (Polytetrafluoroethylene), FEP (fluorinated ethylene-propylene), PVDF (polyvinylidene fluoride), fluorocarbon rubber; and silicone elastomer, such as methylphenyl silicone elastomer, but not limited to these. These can be used alone or used with filler material, as required.

Further, the blade 24*a* may be pressed to the photoconductor drum 1 with a linear load of preferably from 5 gf/cm to 80 gf/cm, more preferably from 10 gf/cm to 60 gf/cm, which is effective for extending and forming a protective layer on the photoconductor drum 1. If the linear load is too small, the protective agent may not be effectively extended on the photoconductor drum 1, which is not preferable. If the linear load is too great, the blade 24*a* may be abraded in a shorter time, and the photoconductor drum 1 may be damaged or abraded in a shorter of time, which is not preferable.

A description is now given to the agent applicator 22. The agent applicator 22 may preferably be a brush roller having a number of brush fibers, which is used for supplying a protective agent to the photoconductor drum 1. Such brush fibers have a given level of flexibility to reduce or suppress mechanical stress to be applied to a surface of the photoconductor drum 1.

Such brush fibers having some flexibility may be made of known materials having flexibility, such as polyolefin resin (e.g., polyethylene, polypropylene); polyvinyl resin and polyvinylidene resin (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone); copolymer of polyvinyl chloride/vinyl acetate; copolymer of styrene/acrylic acid; styrene/butadiene resin; fluorocarbon polymer (e.g., polytetrafluoroethylene, polyvinyl fluoride, polyvinylidene fluoride, polychlorotrifluoroethylene); polyester; nylon; acrylic; rayon; polyurethane; polycarbonate; phenol resin; and amino resin (e.g., urea/formaldehyde resin, melamine resin, benzog anamine resin, urea resin, polyamide resin), for example. Such materials can be used alone or in combination. Further, to adjust flexibility of brush fibers, diene rubber, styrene-butadiene rubber (SBR), ethylene-propylene rubber, isoprene rubber, nitrile rubber, urethane rubber, silicone rubber, hydrin rubber, and norbornene rubber, or the like can be added.

Such brush roller used as the agent applicator 22 have a core metal and brush fibers formed on the core metal by winding brush fibers in a spiral manner, for example. Such brush fibers may have a fiber diameter of from 10 μm to 500 μm, and more preferably from 20 μm to 300 μm. If the fiber diameter is too small, a supplying or applying speed of a protective agent becomes too slow.

If the fiber diameter is too great, the number of brush fibers per unit area becomes small, by which brush fibers may not contact the photoconductor drum 1 uniformly. If the brush fibers do not contact the photoconductor drum 1 uniformly, a protective agent may not be uniformly applied to a surface of the photoconductor drum 1. Further, if the fiber diameter is too great, brush fibers may be more likely to cause damages to the photoconductor drum 1. Further, if the fiber diameter is too great, brush fibers may scrape a protective agent with a greater force, by which a lifetime of the protective agent becomes shorter. Further, if the fiber diameter is too great, brush fibers may supply a protective agent having relatively larger sized particles to the photoconductor drum 1, by which such particles may adhere and contaminate a charge roller. Further, if the fiber diameter is too great, a greater torque may be required to rotate the brush roller or the photoconductor drum 1, which is not preferable.

Such brush fiber has a fiber length of from 1 mm to 15 mm, and more preferably from 3 mm to 10 mm. If the length of brush fiber is too small, the core metal of the agent applicator 22 may be disposed too close to the photoconductor drum 1, by which the core metal may contact and cause damages to the photoconductor drum 1, which is not preferable. If the length of brush fiber is too great, brush fibers may scrape a protective agent with a smaller force and brush fibers may contact the photoconductor drum 1 with a smaller force, in which the protective agent may not be effectively supplied to the photoconductor drum 1 and the brush fibers may be more likely to drop from the core metal, which are not preferable.

Such brush fiber has a fiber density of 10,000 to 300,000 fibers per square inch (or $1.5\times10^7$ to $4.5\times10^8$ fibers per square meter). If the fiber density is too small, a protective agent may not be uniformly applied to a surface of the photoconductor drum 1, or the protective agent may not be effectively supplied to the photoconductor drum 1, which are not preferable. If the fiber density is too great, a diameter of brush fiber may need to be set to a significantly smaller size, which is not preferable.

Such brush roller preferably has a higher fiber density to uniformly and stably supply a protective agent to the photoconductor drum 1, in which one brush fiber may be preferably made of a bundle of tiny fibers such as several to hundreds of tiny fibers. For example, one brush fiber may be composed of a bundle of 50 tiny fibers, in which one tiny fiber has 6.7 decitex (6 denier) and a bundle of 50 filaments has a value of 333 decitex computed by a equation of 6.7 decitex×50 filament (or 300 denier=6 denier×50 filament).

Such brush fiber is preferably made of single fiber having a diameter of 28 μm to 43 μm, more preferably 30 μm to 40 μm, to effectively and efficiently supply a protective agent. Because brush fibers are generally made by twisting fibers, brush fibers may not have a uniform fiber diameter, and thereby a unit of "denier" and "decitex" are used in general. However, if a single fiber is used as one brush fiber, brush fibers have a uniform fiber diameter, and thereby brush fibers may be preferably defined by a fiber diameter. If the single fiber has too small diameter, a protective agent may not be efficiently supplied, which is not preferable. If the single fiber has too great diameter, the single fiber has too great stiffness, by which the photoconductor drum 1 may be damaged, which is not preferable.

Further, such single fiber having a diameter of 28 μm to 43 μm is preferably implanted to a surface of the core metal in a perpendicular direction, and electrostatic implantation method using electrostatic force may be preferably used to implant brush fibers on the core metal. In an electrostatic implantation method, an adhesive agent is applied to the core metal, and then the core metal is charged. Under such charged condition, a number of single fibers are dispersed in a space using electrostatic force, and then implanted on the core metal applied with the adhesive agent. The adhesive agent is hardened after such implantation to form a brush roller. As such, a brush roller having a fiber density of 50,000 to 600,000 fibers per square inch can be made by an electrostatic implantation method.

Further, such brush fiber may have a coat layer on a surface of fiber, as required, to stabilize a surface shape and fiber property against environmental effect, for example.

The coat layer may be made of material, which can change its shape when brush fibers flex. Such material having flexibility may be polyolefin resin (e.g., polyethylene, polypropylene, chlorinated polyethylene, chlorosulfonated polyethylene); polyvinyl and polyvinylidene resin such as polystyrene, acrylic (e.g., polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone; copolymer of polyvinyl chloride/vinyl acetate; silicone resin or its modified compound having organosiloxane bonding (e.g., modified compound of alkyd resin, polyester resin, epoxy resin, polyurethane); fluorocarbon resin, such as perfluoro alkylether, polyfluorovinyl, polyfluorovinylvinyliden, polychlorotrifluoroethylene; polyamide; polyester; polyurethane; polycarbonate; amino resin, such as urea/formaldehyde resin; and epoxy resin, for example. These materials can be used alone or in combination.

In an exemplary embodiment, the process cartridge PC includes a charging unit using corona discharge, scorotron charging, or a charge roller shown in FIG. 3. From a viewpoint of reducing a size of apparatus and oxidizing gas generation, such as ozone, a charge roller is preferably used.

The charge roller 3 may contact the photoconductor drum 1 or may be disposed opposite to the photoconductor drum 1 across a gap, such as 20 μm to 100 μm. Such charge roller 3, applied with a given voltage, charges the photoconductor drum 1. The charge roller 3 charges the photoconductor drum 1 with a direct-current voltage (referred as DC charging), or a superimposed voltage superimposing a given alternating voltage to a direct-current voltage (referred as AC charging), for example.

In the AC charging method, electric discharges are repeatedly occurred between the photoconductor drum 1 and the charge roller 3 for thousands of times per second, and thereby the photoconductor drum 1 may receive damages during a charging process. In view of such damages, a protective agent may be applied to the photoconductor drum 1 to protect the photoconductor drum 1 from an effect of the AC charging. Specifically, a coating ratio of the photoconductor drum 1 by the protective agent is set to 70% or more when the AC charging method is used for a charging process, for example.

When the DC charging method is used for a charging process, the photoconductor drum 1 may receive damages smaller than the AC charging. Accordingly, a coating ratio of the photoconductor drum 1 by the protective agent is set to 60% or more for the DC charging method, for example.

The charge roller 3 may be preferably configured with a conductive supporter, a polymer layer, and a surface layer. The conductive supporter, used as a supporter and an electrode of the charge roller 3, is made of a conductive material, such as metal or metal alloy (e.g., aluminum, cupper alloy, stainless steel), metal (e.g., iron) coated with chrome or nickel, or resin added with a conductive material, for example.

The polymer layer may be a conductive layer having a given resistance, such as from $10^6$ Ωcm to $10^9$ Ωcm, in which a conductive agent is added in a polymeric material to adjust a resistance. Such polymeric material may be thermoplastic elastomer, such as polyester, polyolefin; thermoplastic resin having styrene, such as polystyrene, copolymer of styrene/butadiene, copolymer of styrene/acrylonitrile, copolymer of styrene/butadiene/acrylonitrile; rubber material, such as isoprene rubber, chloroprene rubber, epichloro hydrin rubber, butyl rubber, urethane rubber, silicone rubber, fluorocarbon rubber, styrene/butadiene rubber, butadiene rubber, nitrile rubber, ethylene-propylene rubber, epichlorohydrin/ethyleneoxide copolymer rubber, epichlorohydrin/ethyleneoxide/allylglycidyl ether copolymer rubber, ethylene/propylene/dien copolymer rubber (EPDM), acrylonitrile/butadiene copolymer rubber, natural rubber, and rubber mixing these rubber materials. Among the rubber materials, silicone rubber, ethylene/propylene rubber, epichlorohydrin/ethyleneoxide copolymer rubber, epichlorohydrin/ethyleneoxide/allylglycidyl ether copolymer rubber, acrylonitrile/butadiene copolymer rubber, and rubber mixing these rubber materials are preferably used. Such rubber materials may be foamed rubber or unfoamed rubber.

The conductive agent may be an electronic conductive agent, or an ion conductive agent, for example. The electronic conductive agent may be fine powders of carbon black, such as ketjen black, acetylene black; thermal decomposed carbon, graphite; conductive metal or alloy, such as aluminum, cupper, nickel, stainless steel; conductive metal oxide, such as tin oxide, indium oxide, titanium oxide, tin oxide/antimony oxide solid solution, tin oxide/indium oxide solid solution; and surface-treated insulation material having conductivity, for example. The ion conductive agent may be perchlorate or chlorate of tetraethyl ammonium or lauryl trimethyl ammonium; and perchlorate or chlorate of alkali metal or alkaline-earth metal, such as lithium, magnesium, for example. Such conductive agents may be used alone or in combination.

Although such conductive agents may be added to a polymeric material with a given amount, the electronic conductive agent is added to a 100 weight part of polymeric material for a range of 1 to 30 weight part, and more preferably a range of 15 to 25 weight part, and the ion conductive agent is added to a 100 weight part of polymeric material for a range of 0.1 to 5.0 weight part, and more preferably a range of 0.5 to 3.0 weight part.

The surface layer of the charge roller 3, composed of polymeric material, may have a dynamic ultra-micro hardness of from 0.04 to 0.5, for example. Such polymeric material may be polyamide, polyurethane, polyvinylidene fluoride, copolymer of ethylene tetrafluoride, polyester, polyimide, silicone resin, acrylic resin, polyvinyl butyral, copolymer of ethylene tetrafluoroethylene, melamine resin, fluorocarbon rubber, epoxy resin, polycarbonate, polyvinyl alcohol, cellulose, polyvinylidene chloride, polyvinyl chloride, polyethylene, copolymer of ethylene vinyl acetate, or the like, for example. From a viewpoint of separation performance with toner, polyamide, polyvinylidene fluoride, copolymer of ethylene tetrafluoride, polyester, and polyimide are preferably used. Such polymeric materials can be used alone or in combination. Such polymeric material has a number average molecular weight, preferably in a range of 1,000 to 100,000, and more preferably in a range of 10,000 to 50,000, for example.

The surface layer is formed by mixing the polymeric material, the conductive agent, and fine powders. The fine powders may be metal oxide or complex metal oxide, such as silicon oxide, aluminum oxide, barium titanate, or polymer powder of tetrafluoroethylene, vinylidene fluoride, for example, but not limited thereto. Such fine powders can be used alone or in combination.

A description is given to a development unit used in a process cartridge according to an exemplary embodiment with reference to FIG. 3. The process cartridge includes a development unit to develop a latent image formed on the photoconductor drum 1 as a toner image using a developing agent. Such developing agent may be one-component developing agent not having carrier, and two-component developing agent having toner and carrier. As shown in FIG. 3, the development unit 5 includes a developing roller 51 used as a developing agent carrier, partially exposed to the photoconductor drum 1 through an opening of a casing of the development unit 5.

Toner particles supplied to the development unit 5 from a toner bottle (not shown) are agitated with carrier particles and transported by agitation transport screws 52 and 53, and then carried on the developing roller 51.

The developing roller 51 includes a magnet roller and a developing sleeve. The magnet roller generates a magnetic field, and the developing sleeve coaxially rotates around the magnet roller. Chains of carrier particles of the developing agent accumulate on the developing roller 51 with an effect of magnetic force of the magnet roller, and then transported to a developing section facing the photoconductor drum 1.

The developing roller 51 may rotate at a linear velocity greater than a linear velocity of the photoconductor drum 1 at the developing section, for example. Chains of carrier particles accumulated on the developing roller 51 contact a surface of the photoconductor drum 1, and supply toner particles adhered on the carrier surface to the surface of the photoconductor drum 1. At this time, the developing roller 51 is applied with a developing bias from a power source (not shown) to form a developing electric field at the developing section. In such developing electric field, toner particles move from the developing roller 51 to a latent image on the photoconductor drum 1, and adhere the latent image. Such toner adhesion to the latent image of the photoconductor drum 1 generates a toner image of each color.

A description is now given to toner for use in an exemplary embodiment. The toner preferably has an average circularity of from 0.93 to 1.00, and more preferably from 0.95 to 0.99. In an exemplary embodiment, an average value obtained by the following (Equation 1) is defined as circularity of toner particles. The average circularity is an index of the degree of irregularities of toner particles. If the toner has a perfect sphericity, the average circularity takes a value of 1.00. The more irregularities of surface profile, the smaller the average circularity.

Circularity *SR*=(circumferential length of a circle having an area equivalent to a projected area of a particle)/(circumferential length of a projected image of the particle) (Equation 1)

If the average circularity is in a range of 0.93 to 1.00, toner particles may have smooth surface, and thereby toner particles contact with each other at a small contact area, and toner particles and the photoconductor drum 1 also contact with each other at a small contact area, by which such toner particles can have an excellent transfer performance. Further, because such toner particles have no corners, an agitation torque for the developing agent in the developing unit 3 can be set smaller, and thereby the agitation can be conducted in a stable manner, by which defective images may not occur.

Further, because such toner particles have no corners, a pressure, applied to toner particles when transferring a toner image to a transfer member or a recording member, can be uniformly applied to the toner particles used for forming dot images. Accordingly, a void may not occur on a transferred image. Further, because such toner particles have no corners, the toner particles may not have grinding force so much, by which such toner particles may not damage or wear the surface of the photoconductor drum 1.

A description is given to a method of measuring circularity of toner particles. The degree of circularity SR of particles can be measured by using a flow-type particle image analyzing apparatus FPIA-1000 produced by Toa Medical Electronics Co., Ltd. Such measuring may be conducted as below.

First, 0.1-0.5 ml of surfactant, preferably alkyl benzene sulfonate, as a dispersing agent, is added to 100-150 ml of water in a container from which impurities have been removed in advance, and about 0.1-0.5 g of measurement sample is further added thereto. Then, an ultrasonic wave is applied to a suspension having a sample dispersed therein for 1 to 3 minute to set a suspension dispersion density as 3,000-10,000 particles/μl, and the shape of a toner particles and distribution of the degree of circularity of toner particles are measured by using the above-mentioned flow-type particle image measuring apparatus.

A weight-average particle diameter D4 of toner particles is preferably from 3 μm to 10 μm, and more preferably from 4 μm to 8 μm, for example. In this range, the toner particles may have a diameter, which is a sufficiently small size for developing fine dots of latent image. Accordingly, such toner particles may have good reproducibility of image dots.

If the weight-average particle diameter D4 is too small, a phenomenon such as lower transfer efficiency and lower blade cleaning performance may be more likely to occur. If the weight-average particle diameter D4 is too great, toner for forming characters and lines may unfavorably sputter.

Further, the toner particles preferably have a ratio (D4/D1) of from 1.00 to 1.40, and more preferably from 1.00 to 1.30, wherein the D4/D1 is a ratio of the weight-average particle diameter D4 and the number-average particle diameter D1. The closer the ratio (D4/D1) is 1, the sharper the toner size distribution of the toner particles. If the (D4/D1) is in a range of 1.00 to 1.40, an latent image can be developed by any toner particles having different particle diameters but set in such D4/D1 ratio, by which an image having higher quality can be produced.

Further, because the toner particles have a sharper size distribution, a tribo electrically-charging profile of toner particles becomes also sharp, by which fogging can be suppressed. Further, if toner particles have uniform diameter, the toner particles can be developed on a latent image dot in a precise array manner, and thereby dot reproducibility by toner particles becomes excellent.

The weight average particle diameter (D4), number average particle diameter (D1), and particle diameter distribution of a toner can be measured using an instrument COULTER COUNTER TA-II or COULETR MULTISIZER II from Coulter Electrons Inc.

The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the weight average particle diameter (D4) and the number average particle diameter (D1) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Such substantially spherically shaped toner particles can be prepared by a cross-linking reaction and/or an elongation reaction of toner composition in an aqueous medium in the presence of fine resin particles. Specifically, the toner composition includes a polyester prepolymer having a functional group containing nitrogen atom, a polyester, a colorant, and a release agent, for example. The surface of toner particles prepared by such method can be hardened, by which hot offset can be suppressed, and thereby a contamination of a fixing unit by toner particles can be suppressed. Accordingly, an occurrence of defective images can be suppressed.

A prepolymer formed as modified polyester resin may be polyester prepolymer (A) having isocyanate group, and amine (B) may be elongated or cross-linked with the polyester prepolymer (A).

The polyester prepolymer (A) having isocyanate group may be a reaction product of polyester with polyisocyanate (3), in which the polyester is a polycondensation product of polyol (1) and polycarboxylic acid (2) and having an active hydrogen group. The active hydrogen group of the polyester may be hydroxyl group (e.g., alcoholic hydroxyl group, phenolic hydroxyl group), amino group, carboxyl group, and mercapto group, for example. Among these, alcoholic hydroxyl group is preferred.

Examples of the polyol (1) include diol (1-1) and tirvalent or more polyol (1-2), and (1-1) alone or a mixture of (1-1) and small amount of (1-2) is preferably used.

Examples of the diol (1-1) include alkylene glycol (e.g., ethylene glycol, 1,2-propylene glycol, 1,3-propylene glycol, 1,4-butane diol, 1,6-hexane diol); alkylene ether glycol (e.g., diethylene glycol, triethylene glycol, dipropylene glycol, polyethylene glycol, polypropylene glycol, polytetramethylene ether glycol); alicyclic diol (e.g., 1,4-cyclohexane dimethanol, hydrogenated bisphenol A); bisphenol(e.g., bisphenol A, bisphenol F, bisphenol S); adduct of alkylene oxide of the alicyclic diol (e.g., ethylene oxide, propylene oxide, butylene oxide); and adduct of alkylene oxide of the bisphenol (e.g., ethylene oxide, propylene oxide, butylene oxide). Among these, alkylene glycol having a carbon number of 2 to 12 and adduct of the alkylene oxide of the bisphenol are preferable. Particularly preferable are the adduct of the alkylene oxide of the bisphenol, and a combination of an adduct of the alkylene oxide of the bisphenol and alkylene glycol having a carbon number of 2 to 12.

Examples of the tirvalent or more polyol (1-2) include trihydric to otcahydric alcohols and polyvalent aliphatic alcohol (e.g., glycerin, trimethylolethane, trimethylolpropane, pentaerythritol, sorbitol); tirvalent or more phenol (e.g., trisphenol PA, phenol borax, cresol novolac); and adduct of alkylene oxide of the tirvalent or more polyphenol.

Examples of the polycarboxylic acid (2) include dicarboxylic acid (2-1) and a tirvalent or more polycarboxylic acid (2-2), and (2-1) alone or a mixture of (2-1) and a small amount of (2-2) are preferably used. Examples of the dicarboxylic acid (2-1) include alkylene dicarboxylic acid (e.g., succinic acid, adipic acid, sebacic acid); alkenylene dicarboxylic acid (e.g., maleic acid, fumaric acid); and aromatic dicarboxylic acid (e.g., phthalic acid, isophthalic acid, terephthalic acid, naphthalen dicarboxylic acid). Among these, alkenylene dicarboxylic acid having a carbon number of 4 to 20 or aromatic dicarboxylic acid having a carbon number of 8 to 20 are preferable. Examples of the tirvalent or more polycarboxylic acid (2-2) include aromatic polycarboxylic acid having a carbon number of 9 to 20 (e.g., trimellitic acid, pyromellitic acid). Acid anhydrides or lower alkyl ester (e.g., methyl ester, ethyl ester, isopropyl ester) of the polycarboxylic acid (2) may be reacted with polyol (1).

A ratio of the polyol (1) and the polycarboxylic acid (2) is preferably from 2/1 to 1/1, more preferably from 1.5/1 to 1/1, and further preferably from 1.3/1 to 1.02/1 as an equivalent ratio of [OH]/[COOH] between hydroxyl group [OH] and carboxyl group [COOH].

Examples of the polyisocyanate (3) include aliphatic polyisocyanate (e.g., tetramethylene diisocyanate, hexamethylene diisocyanate, 2,6-diisocyanate methyl caproate); alicyclic polyisocyanate (e.g., isophorone diisocyanate, cyclohexylmethane diisocyanate); aromatic diisocyanate (e.g., tolylene diisocyanate, diphenylmethane diisocyanate); aromatic aliphatic diisocyanate (e.g., α,α,α', α'-tetramethylxylylene diisocyanate); isocyanates; and compounds formed by blocking the polyisocyanate phenol derivative, oxime, or caprolactam. These can be used alone or in combination.

A ratio of the polyisocyanate (3) is preferably from 5/1 to 1/1, more preferably from 4/1 to 1.2/1, and further preferably from 2.5/1 to 1.5/1 as an as an equivalent ratio of [NCO]/[OH] between isocyanate group [NCO] and hydroxyl group [OH] of polyester having hydroxyl group. If the [NCO]/[OH] becomes too great, low-temperature fixability of the toner may deteriorate. For example, if the molar ratio of [NCO] becomes less than 1, the urea content in modified polyester becomes lower, by which hot offset resistance may be degraded.

The content of polyisocyanate (3) in the prepolymer (A) having isocyanate group is preferably from 0.5 wt % to 40 wt %, more preferably from 1 wt % to 30 wt %, and further preferably from 2 wt % to 20 wt %. If the content of polyisocyanate (3) is too small, hot offset resistance may be degraded, and a compatibility of thermostable preservability of the toner and low-temperature fixability of the toner may deteriorate. If the content of polyisocyanate (3) is too great, low-temperature fixability of the toner may deteriorate.

The number of isocyanate group contained in one molecule of the prepolymer (A) having isocyanate group is preferably at least 1, more preferably an average of 1.5 to 3, and further preferably an average of 1.8 to 2.5. If the number of isocyanate group per molecule is less than 1, the molecular weight of urea-modified polyester becomes lower, by which hot offset resistance may be degraded.

Examples of the amine (B) include diamine (B1), tirvalent or more polyamine (B2), amino alcohol (B3), amino mercaptan (B4), amino acid (B5), and compound (B6) of B1 to B5 in which amino group is blocked.

Examples of the diamine (B1) include aromatic diamine (e.g., phenylene diamine, diethyl toluene diamine, 4,4'diaminodiphenylmethane); alicyclic diamine (e.g., 4,4'-diamino-3, 3'dimethyldicyclohexylmethane, diaminecyclohexane, isophorone diamine); and aliphatic diamine (e.g., ethylene diamine, tetramethylene diamine, hexamethylene diamine). Examples of the tirvalent or more polyamine (B2) include diethylene triamine, triethylene tetramine. Examples of the amino alcohol (B3) include ethanolamine and hydroxyethylaniline. Examples of the amino mercaptan (B4) include aminoethyl mercaptan and aminopropyl mercaptan. Examples of the amino acid (B5) include aminopropionic acid and aminocaproic acid. Examples of the compound (B6), in which amino group of B1 to B5 is blocked, include ketimine compound and oxazoline compound obtained from amines of B1 to B5 or ketones (e.g., acetone, methyl ethyl ketone, methyl isobutyl ketone). The preferable amine (B) is B1 alone or a mixture of B1 and a small amount of B2.

Further, a reaction inhibitor can be used, as required, for an elongation reaction to adjust a molecular weight of urea-modified polyester. Examples of the reaction inhibitor include monoamine (e.g., diethylamine, dibuthylamine, buthylamine, laurylamine) and compound (e.g., ketimine compound), in which monoamine is blocked.

A ratio of the amine (B) is preferably from 1/2 to 2/1, more preferably from 1.5/1 to 1/1.5, and further preferably from 1.2/1 to 1/1.2 as an equivalent ratio of [NCO]/[NHx] of isocyanate group [NCO] in the prepolymer (A) having isocyanate group and amino group [NHx] in the amine (B). If the [NCO]/[NHx] becomes too great or too small, a molecular weight of urea-modified polyester (i) becomes lower, and hot offset resistance may be degraded. In an exemplary embodiment, the urea-modified polyester (i) may have an urea bond and an urethane bond. A molar ratio of urea bond content and urethane bond content is preferably from 100/0 to 10/90, more preferably from 80/20 to 20/80, and further preferably from 60/40 to 30/70. If the molar ratio of urea bond becomes too small, hot offset resistance may be degraded.

The modified polyester such as urea-modified polyester (i), to be used for toner particles, can be manufactured by these reactions. The urea-modified polyester (i) can be prepared by a one shot method or a prepolymer method, for example. The weight-average molecular weight of the urea-modified polyester (i) is preferably 10,000 or more, more preferably from 20,000 to 10,000,000, and further preferably from 30,000 to 1,000,000. If the weight-average molecular weight is less than 10,000, hot offset resistance may be degraded. Further, the number average molecular weight of urea-modified polyester (i) is not particularly limited when an unmodified polyester (ii), to be described later, is used. In such a case, the number average molecular weight of the urea-modified polyester (i) is set to a given value which can obtain the aforementioned weight-average molecular weight.

When the urea-modified polyester (i) is used alone, the number average molecular weight is preferably 20,000 or less, more preferably from 1,000 to 10,000, and further preferably from 2,000 to 8,000. If the number average molecular weight becomes too great, low-temperature fixability of the toner may deteriorate and glossiness of images may be deteriorated when used for full-color image forming.

In an exemplary embodiment, the urea-modified polyester (i) can be used alone, and the urea-modified polyester (i) can be used with unmodified polyester (ii) as binder resin component. By using the urea-modified polyester (i) with the unmodified polyester (ii), low-temperature fixability of the toner and glossiness of full color image can be preferably enhanced compared to a case using the urea-modified polyester (i) alone.

Examples of the unmodified polyester (ii) include polycondensation product of the polyol (1) and polycarboxylic acid (2) as similar to the urea-modified polyester (i), and preferred compounds are the same as urea-modified polyester (i). Further, the unmodified polyester (ii) may not limited to unmodified polyester, but may also include compounds modified by chemical bond other than urea bond, such as urethane bond. From a viewpoint of low-temperature fixability of the toner and hot offset resistance, it is preferable that the urea-modified polyester (i) and the unmodified polyester (ii) are at least partially soluble each other. Accordingly, it is preferable that polyester component of (i) and (ii) have similar compositions. When (ii) is mixed with (i), a weight ratio of (i) and (ii) is preferably from 5/95 to 80/20, more preferably from 5/95 to 30/70, further preferably from 5/95 to 25/75, and still further preferably from 7/93 to 20/80. If the weight ratio of (i) is too small, such as less than 5 wt %, hot offset resistance may be degraded, and a compatibility of thermostable preservability of the toner and low-temperature fixability of the toner may deteriorate.

The peak molecular weight of (ii) is preferably from 1,000 to 30,000, more preferably from 1,500 to 10,000, and further preferably from 2,000 to 8,000. If the peak molecular weight becomes too small, thermostable preservability of the toner may deteriorate. If the peak molecular weight becomes too great, low-temperature fixability of the toner may deteriorate.

A hydroxyl group value of (ii) is preferably 5 or more, more preferably from 10 to 120, and further preferably from 20 to 80. If the hydroxyl group value is too small, a compatibility of thermostable preservability of the toner and low-temperature fixability of the toner may deteriorate. An acid value of (ii) is preferably from 1 to 30, and more preferably from 5 to 20. By having such acid value, the unmodified polyester (ii) can be easily set to a negative charged condition.

A glass-transition temperature (Tg) of the binder resin is preferably from 50 to 70 degrees Celsius, and more preferably from 55 to 65 degrees Celsius. If the glass-transition temperature is too low, toner particles may be easily subjected to a blocking phenomenon at a higher temperature, which is not preferable. If the glass-transition temperature is too high, low-temperature fixability of the toner may deteriorate.

Under the existence of the urea-modified polyester resin, toner particles of an exemplary embodiment has a good level of thermostable preservability even if the glass-transition temperature is low compared to known polyester-based toner particles.

The temperature (TG') that the binder resin has a storage modulus of 10,000 dyne/cm$^2$ at a measurement frequency of 20 Hz is preferably 100 degrees Celsius or more, and more preferably from 110 to 200 degrees Celsius. If the temperature TG' is too low, hot offset resistance may be degraded.

The temperature (Tη) that the binder resin has a viscosity of 1,000 poises at a measurement frequency of 20 Hz is preferably 180 degrees Celsius or less, and more preferably from 90 to 160 degrees Celsius. If the temperature Tη becomes too high, low-temperature fixability of the toner may deteriorate. Accordingly, from a viewpoint of compatibility of low-temperature fixability of the toner and hot offset resistance, TG' is preferably set higher than Tη. In other words, a difference between TG' and Tη ("TG'−Tη") is preferably 0 degrees Celsius or more, more preferably 10 degrees Celsius or more, and further preferably 20 degrees Celsius or more. Such difference between TG' and Tη has no specific upper limit value. From a viewpoint of compatibility of thermostable preservability of the toner and low-temperature fixability of the toner, the difference between Tη and TG' is preferably 0 to 100 degrees Celsius, more preferably from 10 to 90 degrees Celsius, and further preferably from 20 to 80 degrees Celsius.

The binder resin can be manufactured by the following method. Polyol (1) and polycarboxylic acid (2) are heated at a temperature of 150 to 280 degrees Celsius under a presence of a known esterification catalyst (e.g., tetrabutoxytitanate, dibuthyltin oxide), and water is distilled under depressurized condition, as required, to obtain polyester having hydroxyl group. Then, such polyester is reacted with polyisocyanate (3) at a temperature of 40 to 140 degrees Celsius to obtain prepolymer (A) having isocyanate group. The prepolymer (A) is reacted with an amine (B) at a temperature of 0 to 140 degrees Celsius to obtain urea-modified polyester. When the polyester is reacted with the polyisocyanate (3) and when the prepolymer (A) is reacted with the amine (B), a solvent can be used, as required. Examples of solvent include aromatic solvent (e.g., toluene, xylene); ketones (e.g., acetone, methyl ethyl ketone, methyl isobutyl ketone); esters (e.g., acetic ether); amide (e.g., dimethyl formamide, dimethyl acetamide), and ether (e.g., tetrahydrofuran), which are inactive to the polyisocyanate (3). When unmodified polyester (ii) is also used, unmodified polyester (ii) is prepared with a method similarly applied to polyester having hydroxyl group, and the unmodified polyester (ii) is solved and mixed with a solution having the modified polyester (i), reacted already.

Although the toner particles used in an exemplary embodiment can be manufactured by a following method, other methods can be used. As an aqueous medium, water may be used singly or in combination with a water-soluble solvent. Examples of the water-soluble solvent include alcohol (e.g., methanol, isopropanol, ethylene glycol), dimethyl formamide, tetrahydrofuran, cellosolves (e.g., methyl cellosolve), and lower ketones (e.g., acetone, methyl ethyl ketone).

The toner particles may be formed by reacting a dispersed prepolymer (A) having isocyanate group with amine (B) in the aqueous medium, or by using the urea-modified polyester (i) prepared in advance.

In the aqueous medium, a dispersion having the urea-modified polyester (i) and prepolymer (A) can be stably formed by adding compositions of toner materials having the urea-modified polyester (i) and prepolymer (A) in the aqueous medium, and by dispersing them by shear force. Toner materials including prepolymer (A) and other toner composition such as a colorant, a colorant master batch, a release agent, a charge control agent, an unmodified polyester resin, or the like can be mixed as a dispersion in the aqueous medium. However, it is more preferable to mix the toner materials in advance, and then to add such mixture in the aqueous medium to disperse such toner materials. Further, other toner materials such as a colorant, a release agent, a charge control agent, or the like are not necessarily mixed when toner particles are formed in the aqueous medium. Such other toner materials can be added after forming toner particles. For example, after forming toner particles having no colorant, a colorant can be added to the toner particles with known dyeing method.

The dispersion method includes known methods, such as a low-speed shearing method, a high-speed shearing method, a friction method, a high-pressure jet method, an ultrasonic wave method, for example, which can be selected depending on purpose. A high-speed shearing method is preferably used to obtain dispersed particles having a particle diameter of from 2 μm to 20 μm. Although a dispersing machine using high-speed shearing method can be rotated at any speed, the dispersing machine is preferably rotated at 1,000 rpm to 30,000 rpm (rotation per minute), and more preferably 5,000 rpm to 20,000 rpm. Although a dispersion time can be set any time, such dispersion time is usually set to 0.1 to 5 minutes for a batch method. The dispersion temperature is usually set to from 0 to 150 degrees Celsius (under pressurized condition), and more preferably from 40 to 98 degrees Celsius. A higher dispersion temperature is preferable because the urea-modified polyester (i) and prepolymer (A) can be easily dispersed when a dispersion solution has a lower viscosity.

The use amount of the aqueous medium with respect to 100 weight parts of toner composition having the urea-modified polyester (i) and prepolymer (A) is preferably 50 to 2,000 weight parts, and more preferably 100 to 1,000 weight parts. If the use amount of the aqueous medium is too small, toner compositions may not be dispersed effectively, by which toner particles having a given particle diameter cannot be obtained. If the use amount of the aqueous medium is too great, the manufacturing may not be conducted economically. Further, a dispersing agent can be used, as required. A dispersing agent is preferably used to obtain sharper particle-size distribution and stable dispersing condition.

In the process of synthesizing the urea-modified polyester (i) from the prepolymer (A), the amine (B) can be added and reacted in the aqueous medium before dispersing the toner compositions. Alternatively, the amine (B) can be added in the aqueous medium after dispersing the toner compositions to cause a reaction on an interface of particles. In this case, urea-modified polyester is formed preferentially on a surface of the toner particles prepared in the aqueous medium, by which a concentration gradient of urea-modified polyester may be set for a toner particle. For example, the concentration of urea-modified polyester may be set higher in a sub-surface portion of a toner particle and set lower in a center portion of a toner particle.

In the above-described reaction, a dispersing agent is preferably used, as required. Examples of the dispersing agent include surfactant, inorganic compound dispersing agent having lower water solubility, high polymer protective colloid, but not limited thereto. These can be selectively used depending on purpose. These can be used alone or in combination. Among these, surfactant is preferably used.

Examples of the surfactant include anionic surfactant, cationic surfactant, nonionic surfactant, and zwitterionic surfactant.

Examples of the anionic surfactant include alkyl benzene sulfonate, α-olefin sulfonate, and phosphate ester. Among these, a compound having fluoroalkyl group is preferable. Examples of the anionic surfactant having the fluoroalkyl group include fluoroalkyl carboxylic acid having a carbon number of 2 to 10 or metal salt thereof, disodium perfluorooctane sulfonyl glutamic acid, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid or its metal salt, perfluoroalkyl carboxylic acid (C7 to C13) or its metal salt, perfluoroalkyl (C4 to C12) sulfonate or its metal salt, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salt, perfluoroalkyl (C6 to C10)-N-ethylsulfonyl glycine salt, and mono perfluoroalkyl (C6 to C16) ethylphosphate ester. Examples of trade name of surfactant having the fluoroalkyl group include SURFLON S-111, S-112, S-113 (manufactured by Asahi Glass Co., Ltd); FLUORAD FC-93, FC-95, FC-98, FC-129 (manufactured by Sumitomo 3M Co., Ltd); UNIDINE DS-101, DS-102 (manufactured by Daikin Industries, Ltd); MEGAFACE F-110, F-120, F-113, F-191, F-812, F-833 (manufactured by Dainippon Ink & Chemicals, Inc.); EKTOP EF-102, 103, 104, 105, 112, 123A, 123B, 306A, 501, 201, 204 (manufactured by Tochem Products Co., Ltd); and FTERGENT F-100, F150 (manufactured by Neos Co., Ltd).

Examples of the cationic surfactant include amine salt surfactant, and quaternary ammonium salt cationic surfactant. Examples of the amine salt surfactant include alkylamine salt, amino alcohol fatty acid derivative, polyamine fatty acid derivative, and imidazoline. Examples of the quaternary ammonium salt cationic surfactant include alkyl trimethyl ammonium salt, dialkyldimethyl ammonium salt, alkyl dimethylbenzyl ammonium salt, pyridinium salt, alkyl isoquinolinium salt, and benzethonium chloride. Examples of the cationic surfactant include aliphatic primary, secondary, or tertiary amine having fluoroalkyl group, aliphatic quaternary ammonium salt, such as perfluoroalkyl (C6 to C10) sulfonamide propyl trimethyl ammonium salt, benzalkonium salt, benzethonium chloride, pyridinium salt, and imidazolinium salt. Trade names of the cationic surfactant include SURFLON S-121 (manufactured by Asahi Glass Co., Ltd); FLUORAD FC-135 (manufactured by Sumitomo 3M Co., Ltd); UNIDINE DS-202 (manufactured by Daikin Industries, Ltd), MEGAFACE F-150, F-824 (manufactured by Dainippon Ink & Chemicals, Inc.); EKTOP EF-132 (manufactured by Tochem Products Co., Ltd); and FTERGENT F-300 (manufactured by Neos Co., Ltd).

Examples of the nonionic surfactant include aliphatic acid amide derivative, and polyalcohol derivative. Examples of the zwitterionic surfactant include alanine, dodecyldi(aminoethyl)glycine, di(octylaminoethyl)glycine, and N-alkyl N,N-dimethylammonium betaine.

Examples of the inorganic compound dispersing agent having lower water solubility include tricalcium phosphate, calcium carbonate, titanium oxide, colloidal silica, and hydroxyapatite. Examples of the high polymer protective colloid include acids, (meth)acrylic monomer having hydroxyl group, vinyl alcohol or vinyl alcohol ether, ester compound having vinyl alcohol and carboxyl group, amide compound or its methylol compound, chloride, homopolymer or copolymer having nitrogen atom or heterocyclic ring of nitrogen atom, polyoxyethylene, and cellulose.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth)acrylic monomer having hydroxyl group include β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, dieethylene glycol monoacrylic ester, diethylene glycol monomethacrylic acidester, glycerin monoacrylic ester, glycerin monomethacrylic ester, N-methylol acrylamide, and N-methylol methacrylamide. Examples of the vinyl alcohol or vinyl alcohol ether include vinyl methyl ether, vinyl ethyl ether, and vinyl propyl ether. Examples of the ester compound having vinyl alcohol and carboxyl group include vinyl acetate, propionic acidvinyl, and vinyl butyrate. Examples of the amide compound or its methylol compound include acrylamide, methacrylamide, diacetone acrylamide acid, or methylol compound thereof. Examples of the chloride include acrylic acid chloride, and methacrylic acid chloride. Examples of the homopolymer or copolymer having nitrogen atom or heterocyclic ring of nitrogen atom include vinylviridin, vinylpyrrolidone, vinylimidazole, and ethyleneimine. Examples of the polyoxyethylene include polyoxyethylene, polyoxypropylene, polyoxyethylene alkylamine, polyoxypropylenealkylamine, polyoxyethylene alkylamide, polyoxypropylenealkylamide, polyoxyethylene nonyl phenyl ether, polyoxyethylene lauryl phenyl ether, polyoxyethylene stearyl phenyl ester, and polyoxyethylene nonyl phenyl ester. Examples of the cellulose include methyl cellulose, hydroxyethyl cellulose, and hydroxypropyl cellulose.

When preparing the aforementioned dispersion solution, a dispersion stabilizer can be used, as required. Such dispersion stabilizer include compound such as calcium phosphate salt, which can be solved in acid or alkali. When such dispersion stabilizer is used, calcium phosphate salt may be removed from fine particles by dissolving calcium phosphate salt using acid, such as hydrochloric acid, and then washing dispersion solution, or calcium phosphate salt may be removed from fine particles through decomposition by enzyme.

When preparing the aforementioned dispersion solution, a catalyst for an elongation reaction and a cross-linking reaction can be used. Such catalyst includes dibuthyltin laurate and dioctyltin laurate, for example.

Further, to decrease the viscosity of toner composition, a solvent, which can solve the urea-modified polyester (i) and prepolymer (A), can be used. Such solvent is preferably used to obtain a sharper particle-size distribution. Such solvent may be preferably volatile, by which solvent can be removed easily.

Examples of the solvent include toluene, xylene, benzene, tetrachloride carbon, dichloromethane, 1,2-dichloroethane, 1,1,2-trichloroethane, trichloroethylene, chloroform, monochlorobenzene, dichloroethylidene, methyl acetate, acetic ether, methyl ethyl ketone, and methyl isobutyl ketone. These can be used alone or in combination. Among these, aromatic solvent such as toluene and xylene, halogenated hydrocarbon such as dichloromethane, 1,2-dichloroethane, chloroform, and tetrachloride carbon are preferably used, and aromatic solvent such as toluene and xylene is more preferably used. The use amount of the solvent with respect to the prepolymer (A) of 100 weight parts is preferably from 0 to 300 weight parts, more preferably from 0 to 100 weight parts, and further preferably from 25 to 70 weight parts. When the solvent is used, the solvent is heated and removed under a normal or reduced pressure condition after an elongation and/or cross-linking reaction.

An elongation and/or cross-linking reaction time is determined based on reactivity of the isocyanate group of the prepolymer (A) and the amine (B). Such reaction time is usually 10 minutes to 40 hours, and preferably from 2 hours to 24 hours. The reaction temperature is preferably from 0 to 150 degrees Celsius, and more preferably from 40 to 98 degrees Celsius. Further, a known catalyst, such as dibuthyltin laurate and dioctyltin laurate, can be used, as required.

To remove an organic solvent from the emulsified dispersion solution, the emulsified dispersion solution is gradually heated to a higher temperature to vaporize and remove the organic solvent from the solution. Alternatively, an emulsified dispersion solution may be sprayed in a dry atmosphere to remove an organic solvent from droplets to form fine toner particles, and aqueous dispersing agent is also vaporized and removed. Such dry atmosphere may be a heated gas atmosphere using air, nitrogen, carbon dioxide, combustion gas, or the like. Such heated gas atmosphere may be heated to a temperature greater than a boiling point of solvent to be used. Targeted quality of toner particles can be obtained by a spray dryer, a belt dryer, or a rotary kiln with a shorter time.

When an emulsified dispersion solution has a broader particle-size distribution, such broader particle-size distribution can be segmented in a plurality of sizes after washing and drying the emulsified dispersion solution to obtain uniformly sized particles. Such segmentation process for separating fine particles size by size can be conducted to the dispersion solution by a cyclone method, a decanter method, or a centrifugal separation method or the like. Although the segmentation process can be conducted to dried particles, obtained by drying the dispersion solution, such segmentation process can be preferably conducted to the dispersion solution from a viewpoint of efficiency. Fine particles, obtained by the segmentation process but not used for product or not so fine particles may be reused in a kneading process to form particles. In such a case, such unnecessary fine particles or not so fine particles may be wet. It is preferable to remove the dispersing agent from the obtained dispersion solution as much as possible, and such removal of dispersing agent is preferably conducted when the segmentation process is conducted, for example.

Such obtained dried toner particles may be mixed other particles, such as a release agent, a charge control agent, a plasticizer, and a colorant, and then a impact force may be applied to the mixed particles to fix or fuse other particles on the surface of toner particles. Such fixed other particles may not be separated from the surface of toner particles so easily.

Specifically, a mixture of particles is applied with an impact force using an impeller vane rotating at a high speed, or a mixture of particles is introduced in a high speed air stream for accelerating particles, and accelerated particles are impacted one another or impacted against an impact plate. Examples of such machines are Ong Mill (manufactured by Hosokawa Micron Corp.), a modified I-type Mill (manufactured by Nippon Pneumatic Mfg. Co., Ltd) using reduced pulverization air pressure, Hybridizaition System (manufactured by Nara Kikai Seisakusho), Cryptron System (manufactured by Kawasaki Heavy Industries, Ltd), and an automatic mortar, for example.

Further, conventional colorants such as pigment and dye can be used as a colorant for the toner particles. Such colorant includes carbon black, lamp black, iron black, ultramarine blue, nigrosin dye, aniline blue, phthalocyanine blue, phthalocyanine green, Hansa yellow G, rhodamine 6C lake, chacloil blue, chrome yellow, quinacridone red, benzidine yellow, and rose bengal, for example. These can be used alone or in combination.

Further, if magnetic property is to be provided to toner particles, toner particles may be contained with magnetic component such as ferric oxide (e.g., ferrite, magnetite, maghemite) or metal and metal alloy of iron, cobalt, nickel, or the like. These magnetic components may be used alone or in combination. Further, such magnetic component may be used as a colorant component.

Further, the colorant used with the toner particles preferably has the number average particle diameter of 0.5 μm or less, more preferably 0.4 μm or less, and further preferably 0.3 μm or less. If the number-average particle diameter becomes too large, pigments may not be dispersed at an adequate level, and a preferable transparency may not be obtained. If the number average particle diameter becomes smaller, such fine colorant particles have a diameter effectively smaller than a half-wave length of visible light, by which such fine colorant particles may not affect reflection and absorption of light. Accordingly, such fine colorant particles may be useful for attaining a good level of color reproducibility and transparency of an OHP (overhead projector) sheet having an image.

If particles having a larger particle diameter are included in colorant in large amount, such larger particles may block transmission of incident light or scatter incident light, by which brightness and vividness of a projected image of OHP sheet may become lower. Further, if such larger particles are included in colorant in large amount, colorant may drop from the surface of toner particles, and thereby causing problems such as fogging, drum contamination, defective cleaning. Specifically, a ratio of colorant having a particle diameter greater than 0.7 μm is preferably 10% or less, and more preferably 5% or less of all colorant.

Further, colorant may be mixed with a binding resin and a moistening agent, and kneaded with the binding resin to adhere the colorant to the binding resin. When the colorant is mixed with the binding resin, such colorant may be dispersed more effectively, and thereby a particle diameter of colorant dispersed in toner particles can be set smaller. Accordingly, a better transparency of an OHP (overhead projector) sheet having an image can be obtained. The binding resin used for such kneading may include resin used as a binding resin for toner, but not limited thereto.

A mixture of the binding resin, colorant, and moistening agent can be mixed by using a blending machine, such as Henschel mixer, and then the mixture is kneaded by a kneading machine having two or three rolls at a temperature set lower than a melting temperature of the binding resin, by which kneaded mixture of the binding resin and colorant can be obtained.

Further, the moistening agent may be water, an organic solvent, such as acetone, toluene, butanone in view of solubility of a binding resin and wet-ability with a colorant, and water is preferably used in view of dispersion performance of colorant. Water is preferable from a viewpoint of environmental load, and keeping dispersion stability of colorant in the following toner manufacturing process. Such process may preferably decrease a particle diameter of colorant particles included in toner particles, and colorant particles can be dispersed more uniformly. Accordingly, color reproducibility of a projected image of OHP sheet can be enhanced.

Further, the toner particles may preferably include a release agent in addition to the binder resin and the colorant. Examples of the release agent include polyolefin wax (e.g., polyethylene wax, polypropylene wax); long-chain hydrocarbon (e.g., paraffin wax, southall wax); and wax carbonyl group. Among these, wax having carbonyl group is preferable. Examples of the wax having carbonyl group include ployalkanoic acid ester (e.g., carnauba wax, montan wax, trimethylolpropane tribehenate, pentaerythritol tetraibehenate, pentaerythritol diacetate dibehenate, glycerin tribehenate, 1,18-octadecanediol distearate); ployalkanol ester (e.g., trimellitic acid tristearyl, distearyl maleate); ployalkanoic acid amide (e.g., ethylenediamine dibehenylamide); polyalkylamide (e.g., tristearylamide trimellitate); and dialkyl ketone (e.g., distearyl ketone). Among these, ployalkanoic acid ester is preferable.

The melting point of the release agent is preferably from 40 to 160 degrees Celsius, more preferably from 50 to 120 degrees Celsius, and further preferably from 60 to 90 degrees Celsius. If the melting point of the release agent is too low, such release agent may affect thermostable preservability of the toner. If the melting point of the release agent is too high, such release agent may more likely cause cold offset when a fixing process is conducted under low temperature.

The viscosity of the melted release agent measured at a temperature higher than the melting point for 20 degrees Celsius preferably has a value of from 5 to 1,000 cps, and more preferably from 10 to 100 cps. If the melted viscosity becomes too great, such release agent may not improve hot offset resistance and low temperature fixability of the toner. A content of the release agent in the toner particles is preferably 0 wt % to 40 wt %, and more preferably from 3 wt % to 30 wt %.

Further, toner particles may include a charge control agent to enhance charge amount and charging speed of toner particles, as required. If the charge control agent is a color material, such charge control agent may change the color of toner particles. Accordingly, colorless material or whitish material is preferably used. Examples of the charge control agent include triphenylmethane dye, chelate molybdate pigment, rhodamine dye, alkoxy amine, quaternary ammonium salt (including fluorine modified quaternary ammonium salt), alkylamide, phosphorus alone or phosphorus compound, tungsten alone or tungsten compound, fluorine-based activator, salicylic acid metal salt, and metal salt of salicylic acid derivative.

Example trade names of the charge control agent include Bontron P-51 as quaternary ammonium salt, E-82 as oxynaphthoic acid metal complex, E-84 as salicylic acid metal complex, E-89 as phenol condensate (manufactured by Orient Chemical Industries, Ltd.); TP-302, TP-415 as quaternary ammonium salt molybdenum complex (manufactured by Hodogaya Chemical Industries, Ltd.); Copy Charge PSY VP2038 as quaternary ammonium salt, Copy Blue PR as triphenyl methane derivative, Copy Charge NEG VP2036 and Copy Charge NX VP434 as quaternary ammonium salt (manufactured by Hoechst Co., Ltd.); LRA-901, LR-147 as boron complex (both manufactured by Japan Carlit Co., Ltd.), quinacridone, azo pigment, and polymer compound having functional group such as sulfonic acid group, carboxyl group, quaternary ammonium salt, or the like.

The adding amount of the charge control agent is determined based on toner manufacturing condition such as types of binder resins, presence or absence of additives, and a dispersion method, or the like. The charge control agent is preferably used in a range of from 0.1 to 10 weight parts, and more preferably from 0.2 to 5 weight parts with respect to the binder resin of 100 weight parts.

If the adding amount of the charge control agent becomes too great, the toner particles may be charged too high, by which an effect of charge control agent is reduced and the toner particles may be attracted to a developing roller with a greater electrostatic attraction force. Therefore, a developing agent may have a lower fluidity, and result in a lower image concentration. Such charge control agent can be melted and kneaded with a resin in a master batch to disperse the charge control agent, or may be added to an organic solvent when to dissolute and disperse the charge control agent, or may be solidified on the surface of toner particles after toner particles are formed.

Further, when dispersing toner compositions in an aqueous medium during a toner manufacturing process, fine resin particles may be added to a solution to stabilize dispersion condition. Such fine resin particles may be any resins, which can be used for dispersion in an aqueous medium, and may be thermoplastic resin or thermosetting resin. Examples of the fine resin particles include vinyl resin, polyurethane resin, epoxy resin, polyester resin, polyamide resin, polyimide resin, silicone resin, phenol resin, melamine resin, urea resin, aniline resin, ionomer resin, and polycarbonate resin. These can be used alone or in combination. Among these, vinyl resin, polyurethane resin, epoxy resin, polyester resin or combination of these are preferably used to obtain spherical fine particles in an aqueous dispersion. Examples of the vinyl resin include homopolymer or copolymer of vinyl monomers, and may be styrene (meth)acrylic acid ester resin, copolymer of styrene/butadiene, copolymer of (meth)acrylic acid-acrylic acid ester, copolymer of styrene/acrylonitrile, copolymer of styrenemaleic anhydride, and copolymer of styrene (meth)acrylic acid.

Further, inorganic fine particles may be preferably used as external additives to facilitate fluidity, developing performance, charged performance of toner particles. Such inorganic fine particles preferably have a primary particle diameter of 5 nm (nanometer) to 2 μm, and more preferably 5 nm to 500 nm. Further, Such inorganic fine particles preferably have a specific surface area of 20 $m^2/g$ to 500 $m^2/g$ measured by the BET method. Such inorganic fine particles are preferably added to the toner particles with 0.01 wt %, to 5 wt %, and more preferably from 0.01 wt % to 2.0 wt %. Examples of the inorganic fine particles include silica, alumina, titanium oxide, barium titanate, magnesium titanate, calcium titanate, strontium titanate, zinc oxide, tin oxide, silica sand, clay, mica isinglass, sand-lime, diatomite, chrome oxide, cerium oxide, colcothar, antimony trioxide, magnesium oxide, zirconium oxide, barium sulfate, barium carbonate, calcium carbonate, silicon carbide, and silicon nitride.

In addition, polymer fine particles obtained by, for example, a soap-free emulsion polymerization, a suspension polymerization, or a dispersion polymerization can be used. Such polymer fine particles may be polystyrene, methacrylic acid ester, copolymer of acrylic acid ester, polycondensation polymer of silicone, polycondensation polymer of benzoganamine, polycondensation polymer of nylon, and polymer particles prepared from thermosetting resin, for example.

Such external additives are subjected to a surface treatment to enhance hydrophobicity, by which a deterioration of fluidity and charged performance of toner particles under high-humidity environment can be suppressed. Examples of preferable surface treatment agent include silane coupling agent, silylating agent, silane coupling agent having fluorinated alkyl group, organic titanate coupling agent, aluminum coupling agent, silicone oil, and modified silicone oil.

Further, a cleaning improving agent may be added to toner composition, to facilitate removal of developing agent remaining on the photoconductor drum 1 or an intermediate transfer member after transfer process. Examples of the cleaning improving agent include aliphatic metal salt (e.g., zinc stearate, calcium stearate, stearic acid); and polymer fine particles manufactured by a soap-free emulsion polymerization (e.g., polymethyl methacrylate fine particles, polystyrene fine particles). Such polymer fine particles have relatively narrower particle-size distribution, and particles having volume-average particle diameter of 0.01 μm to 1 μm is preferable.

By using such toner particles having a good level of developing performance, a higher quality toner image can be produced in stable manner. However, toner particles, not transferred to a transfer member (or recording member) or an intermediate transfer member by a transfer unit but remaining on the photoconductor drum 1, may not be effectively removed by a cleaning unit because toner particles have fine spherical shape, and such toner particles may not be recovered by the cleaning unit. Although toner particles can be removed from the photoconductor drum 1 by pressing a particle remover such as cleaning blade to the photoconductor drum 1 with a greater force, for example, such configuration may shorten a lifetime of the photoconductor drum 1 or cleaning unit, and may not be preferable from a viewpoint of energy saving.

Further, in an exemplary embodiment, in addition to the above-described toner particles used for obtaining high quality images, an image forming apparatus can be used with irregular shaped toner particles prepared by a pulverization method, which may be useful for extending a lifetime of apparatus. Materials for such toner particles may not be limited to any specific materials, but materials used commonly for electrophotography can be used.

Examples of binding resin used for the pulverized toner particles include styrene or homopolymers of styrene derivative substitution (e.g., polystyrene, polyp-chlorostyrene, polyvinyl toluene); styrene copolymer (e.g., styrene/p-chlorostyrene copolymer, styrene/propylene copolymer, styrene/vinyl toluene copolymer, styrene/vinyl naphthalen copolymer, styrene/acrylic acid methyl copolymer, styrene/acrylic acid ethyl copolymer, styrene/acrylic acid buthyl copolymer, styrene/acrylic acid octyl copolymer, styrene/methacrylic acid methyl copolymer, styrene/methacrylic acid ethyl copolymer, styrene/methacrylic acid buthyl copolymer, styrene/α-chloromethacrylic acid methyl copolymer, styrene/acrylonitrile copolymer, styrene/vinyl methyl ketone copolymer, styrene/butadiene copolymer, styrene/isoprene copolymer, styrene/maleic acid copolymer); homopolymer or copolymer of acrylic acid ester (e.g., polymethyl acrylate, polybuthyl acrylate, polymethyl methacrylate, polybuthyl methacrylate methacrylic acid); polyvinyl derivative (e.g., polyvinyl chloride, polyvinyl acetate); polyester polymer, polyurethane polymer, polyamide polymer, polyimide polymer, polyol polymer, epoxy polymer, terpene polymer, aliphatic or alicyclic hydrocarbon resin, and aromatic petroleum resin. These can be used alone or in combination. Among these, styrene acrylic copolymer resin, polyester resin, polyol resin are preferably used in view of electrical property and cost, and polyester resin and polyol resin are preferably used in view of a good level of fixing performance.

The surface layer of the charging member such as charge roller may include a resin component used as binding resin of the toner particles, wherein such resin component may be linear polyester resin composition, linear polyolresin composition, linear styrene acrylic resin compositions or cross-linking composition of these, and at least one of these may be used.

Such pulverized toner particles may be prepared as follows: First, mix the aforementioned resin component and the aforementioned colorant component, a wax component, a charge control component, or the like, as required, then knead such mixture at a temperature slightly lower than a melting temperature of the resin component, and then cool the mixture. After segmenting toner particles size by size, toner particles can be prepared. Such toner particles may be further added with the aforementioned external additives, as required.

In this disclosure, the developing unit may employ a dry type developing method or a wet type developing method, and further may be a single color developing unit or a multi-color developing unit, for example. Such developing unit may include an agitation device for charging the aforementioned toner particles or developing agent by using frictional pressure, and a rotatable magnet roller.

In such developing unit, toner particles and carrier particles are agitated and mixed, and a frictional pressure caused by such agitation charges toner particles. Such charged toner particles may accumulate on the surface of the rotating magnet roller to form magnetic brushes on the magnet roller. Because the magnet roller is disposed near the photoconductor drum 1, toner particles on the magnetic brushes may be attracted to the surface of the photoconductor drum 1 by electrical attraction force. Then, a latent image is developed by the toner particles to form a visible image on the photoconductor drum 1. The developing agent used in the developing unit may be one-component developing agent or two-component developing agent, which may be prepared by the above-described method, for example.

A description is now given to the cleaning member 41 used in the process cartridge PC according to an exemplary embodiment. The cleaning member 41 may be a blade, a brush, or a combination of those, for example. Hereinafter, the cleaning member 41 may be referred as cleaning blade 41, as required.

The cleaning blade 41 is made of any known elastic materials, such as urethane rubber, hydrin rubber, silicone rubber, fluorocarbon rubber, or the like. These materials can be used alone or in combination. Further, the cleaning blade 41 made of rubber blade may be coated with a material having a low frictional coefficient by subjecting the cleaning blade 41 to a coating or dipping process, wherein such low frictional coefficient material may be coated to a portion which contacts the photoconductor drum 1. Further, to adjust hardness of elastic material, a filler such as organic filler or inorganic filler may be dispersed in the elastic material.

The cleaning blade 41 is fixed to a blade supporter by known methods such as adhesion and fusion while pressingly contacting a leading edge of the cleaning blade 41 to the surface of the photoconductor drum 1. The cleaning blade 41 has a thickness of 0.5 mm to 5 mm, and more preferably 1 mm to 3 mm. If the thickness is too small, the cleaning blade 41 may apply a too small contact pressure at a contact face with the photoconductor drum 1, and thereby toner particles remaining on the photoconductor drum 1 may not be effectively scraped, which is not preferable. If the thickness is too great, the cleaning blade 41 may apply a too great contact pressure at the contact face with the photoconductor drum 1, and thereby the photoconductor drum 1 may be damaged, and a greater torque may be in need to rotate the photoconductor drum 1, which are not preferable.

Further, the cleaning blade 41 has a free length portion, which protrudes from the blade supporter and flexes its shape. The free length portion may be determined based on a contact pressure and other factors. In this disclosure, the cleaning blade 41 has a free length portion in a rage of 1 mm to 15 mm, and more preferably 2 mm to 10 mm, for example. If the free length portion is too small, it is hard to fix the cleaning blade 41 to the blade supporter, which is not preferable. If the free length portion is too long, a contact pressure between the cleaning blade 41 and the photoconductor drum 1 may not be maintained at a given level, and thereby a defective cleaning may occur, which is not preferable.

Alternatively, a cleaning blade may be configured with a resilient metal blade and an elastic material formed on the metal blade. For example, a leaf spring may be used as resilient metal blade, and an elastic layer such as resin, rubber, elastomer, may be formed on the leaf spring using a coupling agent or a primer component, as required, by coating or dipping method. Such cleaning blade may be subjected to a thermosetting process, as required, and further subjected to a surface polishing process, as required.

The resilient metal blade has a thickness of about 0.05 mm to 3 mm, and more preferably 0.1 mm to 1 mm. If the thickness of the resilient metal blade is too small, the cleaning blade may apply too small contact pressure at a contact face with the photoconductor drum 1, and thereby toner particles remaining on the photoconductor drum 1 may not be effectively scraped, which is not preferable. If the thickness of the resilient metal blade is too great, the cleaning blade may apply a too great contact pressure at the contact face with the photoconductor drum 1, and thereby the photoconductor drum 1 may be damaged, and a greater torque may be in need to rotate the photoconductor drum 1, which are not preferable.

Further, in case of using such resilient metal blade, the resilient metal blade may be bended in a direction parallel to a support direction after fixing the cleaning blade to the blade supporter to prevent twisting of the cleaning blade. The resilient metal blade may be coated with a surface layer made of fluorocarbon polymer, such as PFA, PTFE, FEP, PVDE, or silicone elastomer, such as fluorocarbon rubber, methyl phenyl silicone elastomer, but not limited to thereto. These can be used with a filler, as required.

Further, the cleaning blade 41 is pressed to the photoconductor drum 1 with a linear load of from 5 gf/cm to 80 gf/cm, more preferably from 10 gf/cm to 60 gf/cm, for example. If the linear load is too small, toner particles may pass through the cleaning blade 41, which is not preferable. If the linear load is too great, the cleaning blade 41 may be abraded in a shorter period of time, and the photoconductor drum 1 may be damaged or abraded in a shorter period of time, which are not preferable.

Further, when the cleaning unit 4 employs a cleaning brush, such cleaning brush may have brush fibers having preferable flexibility to suppress mechanical stress to a surface of the photoconductor drum 1. Such flexible brush fiber may be made of one or more known materials. Examples of such materials include, polyolefin resin (e.g., polyethylene, polypropylene); polyvinyl and polyvinylidene resin (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone); copolymer of polyvinyl chloride/vinyl acetate; copolymer of styrene/acrylic acid; styrene/butadiene resin; fluorocarbon polymer (e.g., polytetrafluoroethylene, polyvinyl fluoride, polyvinylidene fluoride, polychlorotrifluoroethylene); polyester; nylon; acrylic; rayon; polyurethane; polycarbonate; phenol resin; and amino resin (e.g., urea/formaldehyde resin, melamine resin, benzog anamine resin, urea resin, polyamide resin).

Further, to adjust flexibility, diene rubber, styrene-butadiene rubber (SBR), ethylene-propylene rubber, isoprene rubber, nitrile rubber, urethane rubber, silicone rubber, hydrin rubber, and norbornene rubber may be used with the aforementioned materials.

The cleaning brush may be a brush roller, having a core metal and brush fibers formed on the core metal by winding brush fibers in a spiral manner, for example. Such brush fiber has a fiber diameter of from 10 μm to 500 μm, and more preferably from 20 μm to 300 μm. If the fiber diameter is too small, a scraping speed of remaining toner particles becomes too slow, which is not preferable. If the fiber diameter is too great, the number of brush fibers per unit area becomes small, by which brush fibers may not contact the photoconductor drum 1 uniformly. If the brush fibers do not contact the photoconductor drum 1 uniformly, the brush fibers may not uniformly clean a surface of the photoconductor drum 1. Further, if the fiber diameter is too great, the brush fibers may be more likely to cause damages to the photoconductor drum 1, which are not preferable.

Such brush fiber has a fiber length of from 1 mm to 15 mm, and more preferably from 3 mm to 10 mm. If the length of brush fiber is too small, the core metal of the brush roller may be disposed too close to the photoconductor drum 1, by which the core metal may contact and cause damages to the photoconductor drum 1, which is not preferable. If the length of brush fiber is too great, the brush fibers may scrape remaining toner particles with a smaller force and the brush fibers may contact the photoconductor drum 1 with a smaller force, in which remaining toner particles may not be effectively scraped from the photoconductor drum 1 and the brush fibers may be more likely to drop from the core metal, which are not preferable. Such brush fibers have a fiber density of 10,000 to 300,000 fibers per square inch (or $1.5\times10^7$ to $4.5\times10^8$ fibers per square meter). If the fiber density is too small, brush fibers may not uniformly contact a surface of the photoconductor drum 1, by which the brush fibers may not clean or remove toner particles remaining on the photoconductor drum 1, which are not preferable. If the fiber density is too great, a diameter of brush fiber may need to be significantly smaller size, which is not preferable.

The cleaning brush preferably has a higher fiber density to uniformly and stably clean the photoconductor drum 1, in which one brush fiber may be preferably made of a bundle of tiny fibers such as several to hundreds of tiny fibers. For example, one brush fiber may be composed of a bundle of 50 tiny fibers, in which one tiny fiber has 6.7 decitex (6 denier) and a bundle of 50 tiny fibers has a value of 333 decitex computed by 6.7 decitex×50 filament (or 300 denier=6 denier×50 filament).

Further, such brush fiber may have a coat layer on a surface of fiber, as required, to stabilize a surface shape and fiber property against environmental effect, for example. The coat layer may be made of material, which can change its shape when brush fibers flex. Such material having flexibility may be polyolefin resin (e.g., polyethylene, polypropylene, chlorinated polyethylene, chlorosulfonated polyethylene); polyvinyl and polyvinylidene resin, such as polystyrene, acrylic (e.g., polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone; copolymer of polyvinyl chloride/vinyl acetate; silicone resin or its modified compound having organosiloxane bonding (e.g., modified compound of alkyd resin, polyester resin, epoxy resin, polyurethane); fluorocarbon resin such as perfluoro alkylether, polyfluorovinyl, polyfluorovinylvinyliden, polychlorotrifluoroethylene; polyamide; polyester; polyurethane; polycarbonate; amino resin such as urea/formaldehyde resin; and epoxy resin, for example. These materials can be used alone in combination.

Figure 4:
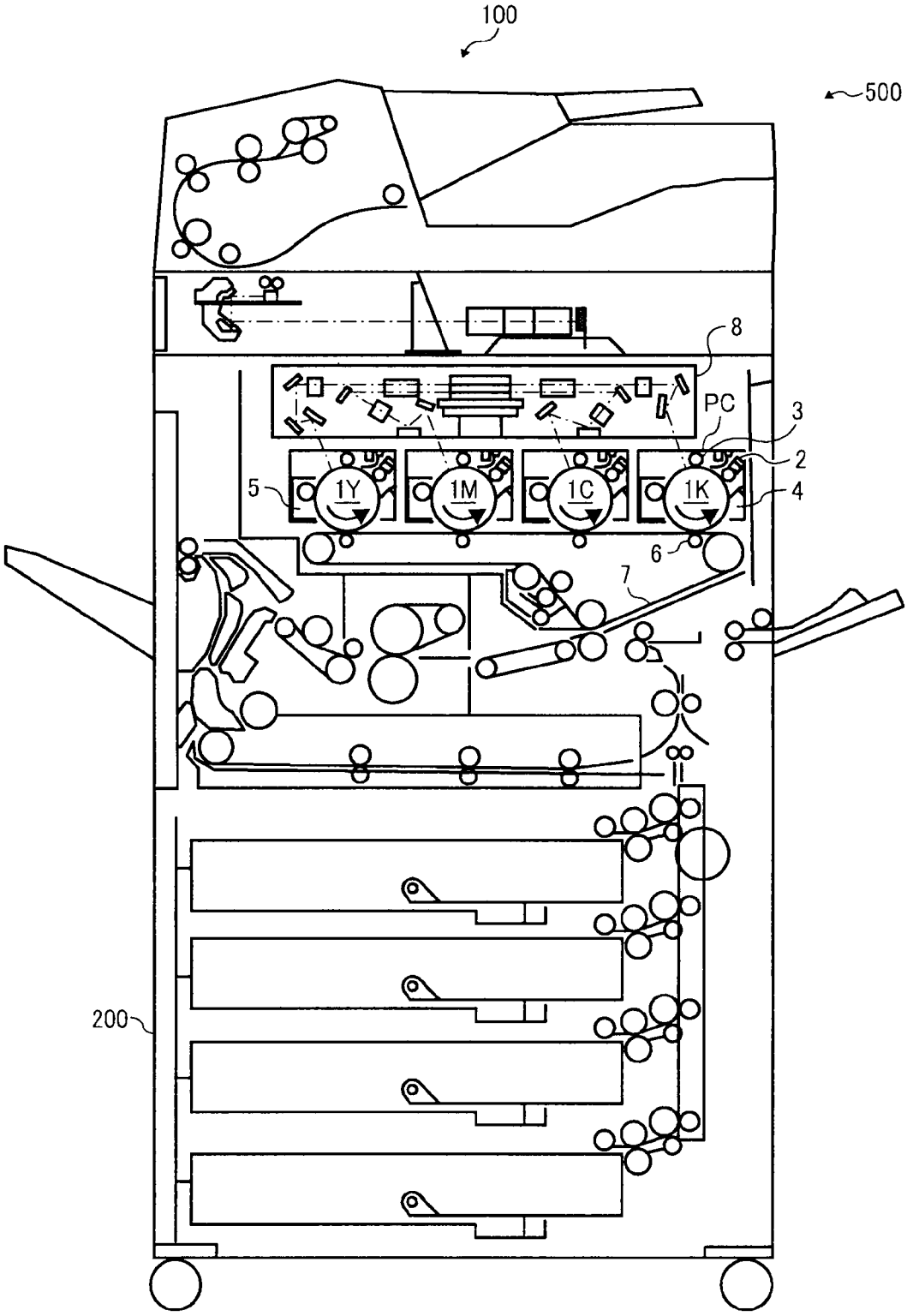
FIG. 4 illustrates a schematic cross-sectional view of an image forming apparatus having a protective layer setting unit according to an exemplary embodiment.

A description is now given to an image forming apparatus according to an exemplary embodiment with reference to FIG. 4. FIG. 4 illustrates a schematic cross-sectional view of an image forming apparatus employing the protective layer setting unit 2 according to an exemplary embodiment. An image forming apparatus 500 of FIG. 4 includes an image scanning unit 100, an optical writing unit 8, the intermediate transfer member 7, and a sheet feed unit 200, for example. The photoconductor drum 1 is surrounded by the protective layer setting unit 2, the charging unit 3, the optical writing unit 8, the development unit 5, the transfer roller 6, and the cleaning unit 4. Hereinafter, an image forming process using negative/positive process is described.

The photoconductor drum 1 may be an OPC (organic photoconductor) having an organic photoconductive layer, which is de-charged by a decharging lamp (not shown) to prepare for an image forming operation. Such photoconductor drum 1 is uniformly charged to a negative charge by the charging unit 3. Such charge unit 3 is applied with a given voltage, such as alternating-voltage superimposed voltage, from a voltage power source (not shown), in which such given voltage is used to charge the photoconductor drum 1 to a given potential. The charged photoconductor drum 1 is then irradiated with a laser beam emitted from the optical writing unit 8 to form a latent image on the charged photoconductor drum 1, in which an absolute potential value of light-exposed portion becomes smaller than an absolute potential value of non-exposed portion.

The laser beam, emitted by a laser diode, is reflected by a polygon mirror rotating at a high speed, and then scanned on the surface of the photoconductor drum 1 in an axial direction of the photoconductor drum 1. Such formed latent image is then developed by a developing agent, supplied from a developing sleeve of the development unit 5, as a visible toner image. The developing agent may be toner-only component or a mixture of toner particles and carrier particles. When developing the latent image, a voltage power source (not shown) may apply a given developing bias voltage to the developing sleeve, wherein such developing bias voltage may be direct-current voltage or a superimposed voltage having superimposed alternating-current voltage to direct-current voltage having a voltage value, set between a potential of light-exposed portion and a potential of non-exposed portion of the photoconductor drum 1, for example.

The toner images formed on the photoconductor drum 1 are transferred to the intermediate transfer member 7 by the transfer roller 6, and such toner image is then transferred to a transfer medium such as a paper fed from the sheet feed unit 200. The transfer roller 6 is preferably applied with a transfer bias voltage having a polarity opposite to a polarity of toner particles. Then, toner particles remaining on the photoconductor drum 1 are removed by the cleaning member 41, and then recovered in a toner recovery section in the cleaning unit 4.

The image forming apparatus 500 may have a plurality of developing units arranged in tandem. The plurality of developing units form different toner color images, and sequentially transfer the toner color images to a transfer medium. Then, the transfer medium is transported to a fixing unit to fix toner images on the transfer medium by applying heat. Alternatively, the plurality of developing units sequentially transfer toner color images to an intermediate transfer medium, and then the toner color images are transferred to a transfer medium such as a paper, and then the toner images is fixed by a fixing unit.

Hereinafter, a description is given to experiment and its results using a process cartridge prepared according to an exemplary embodiment in detail. FIG. 5 illustrates a schematic configuration of the process cartridge used in the experiment.

Photoconductor Drum

An aluminum drum (conductive supporter) having a diameter of 30 mm was coated with a under layer, a charge generation layer, a charge transport layer, and a surface layer in this order, and dried to form the photoconductor drum having a under layer of 3.6 μm thickness, a charge generation layer of about 0.14 μm thickness, a charge transport layer of 23 μm thickness, and a surface layer of about 3.5 μm thickness. The surface layer was coated using a spray method, and other layers were coated using a dipping method. The surface layer was added with alumina having an average particle diameter of 0.18 μm with a weight ratio of 23.8 wt %. Such photoconductor drum was applied with a protective agent to perform the experiment, to be described below, and the experiment results are shown in FIG. 8.

Figure 6:
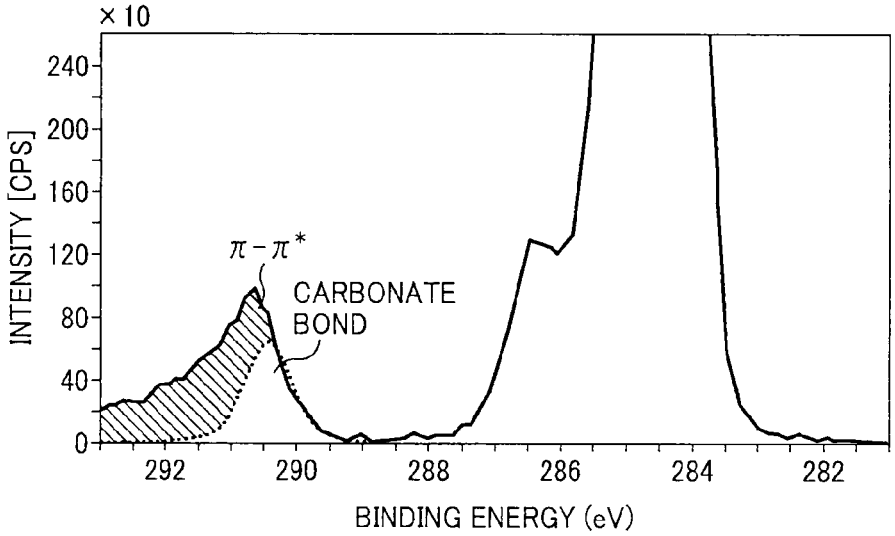
FIG. 6 shows an intensity profile of binding energy for a surface of a photoconductor drum detected by XPS.

FIG. 6 shows an intensity profile of binding energy for a surface of a photoconductor drum, used in the experiment, which was analyzed by XPS before applying a protective agent. The photoconductor drum was analyzed by using an XPS analyzer "AXIS/ULTRA" manufactured by SHIMADZU/KRATOS (having X ray source: Mo no Al, analysis range: 700×300 μm), and C1s spectrum profile shown in FIG. 6 was obtained for a photoconductor drum No. 1.

As above-described, the C1s spectrum profile, detected by analyzing a surface of photoconductor using XPS, is composed of a plurality of peaks, corresponding to different carbon-to-carbon bonding conditions, and different peaks are separated to evaluate each peak having different binding energies. As above described, a peak detected in a range of 290.3 eV to 294 eV, which is used for computing the first area value $A_0$, can be separated in two peaks: one peak is attributed to carbonate bonding (area next to shaded area in FIG. 6), and the other peak is attributed to π-π* transition (shaded area in FIG. 6). The other peak attributed to π-π* transition includes a plurality of peaks, superimposed one another. Accordingly, a peak area detected in a range of 290.3 eV to 294 eV can be computed by separating a plurality of peaks into each peak, determining a peak area of each peak, and adding the peak area value of each peak. However, if the peak area is computed by separating the plurality of peaks, the computing process may need a longer time, which is not preferable. Therefore, the peak area detected in a range of 290.3 eV to 294 eV may be computed by computing the peak area as one area. If a peak in a range of 290.3 eV to 294 eV is superimposed with a peak having a binding energy of 290.3 eV or less, or a peak having a binding energy of 294 eV or more, the peak area in a range of 290.3 eV to 294 eV is computed by a separating a profile corresponding to the binding energy of 290.3 eV or less or the binding energy of 294 eV or more.

As for the photoconductor No. 1, the peak area in a range of 290.3 eV to 294 eV was not superimposed with the binding energy of 290.3 eV or less or the binding energy of 294 eV or more. Accordingly, as for the photoconductor No. 1, the peak area in a range of 290.3 eV to 294 eV was computed as one peak area. As for the photoconductor No. 1, the first area value $A_0$ was detected as 8.8%. In other words, a ratio of the first area value $A_0$ with respect to a total area of C1s spectrum was 8.8% for the photoconductor No. 1.

As similar to the photoconductor No. 1, a surface of a photoconductor drum No. 2 was analyzed by XPS before applying a protective agent. Because the peak area in a range of 290.3 eV to 294 eV for the photoconductor drum No. 2 was not superimposed with the binding energy of 290.3 eV or less or the binding energy of 294 eV or more, the peak area in a range of 290.3 eV to 294 eV was computed as one peak area for the photoconductor No. 2. As for the photoconductor No. 2, the first area value $A_0$ was detected as 8.6%. In other words, a ratio of the first area value $A_0$ with respect to a total area of C1s spectrum was 8.6% for the photoconductor No. 2.

Based on the first area values $A_0$ of the photoconductor drums No. 1 ($A_0$=8.8%) and No. 2 ($A_0$=8.6%), an average first area value was computed as $A_{0\text{-}ave}$ of 8.7%. Such average first area value $A_{0\text{-}ave}$ (8.7%) was used as the first area value $A_0$ when evaluating the experiment results.

The protective agent bars used in the experiments were manufactured as below.

Protective Agent Bar No. 1

FT115 (synthesize wax manufactured by Nippon Seiro Co.,Ltd.) of 90 weight part and TOPAS-™ (manufactured by manufactured by Ticona) of 10 weight part were placed in a glass vessel having a cap, and were agitated and melted at a temperature of 160 to 250 degrees Celsius using a hot stirrer. Then, the melted protective agent was poured in an internal space of an aluminum metal mold, having a size of 12 mm×8 mm×350 mm, heated to 115 degrees Celsius in advance. After cooling to 88 degrees Celsius on a wooden table, the aluminum metal mold is cooled to 40 degrees Celsius on an aluminum table. Then, the solidified product is removed from the mold, and then cooled to an ambient temperature while placing a weight on the product for preventing warping. After that, a protective agent bar No. 1 having a size of 7 mm×8 mm×310 mm was prepared by cutting some portion of the product. The protective agent bar No. 1 was attached with a double face tape and fixed to a metal supporter.

Protective Agent Bar No. 2

FT115 (synthesize wax manufactured by Nippon Seiro Co.,Ltd.) of 58 weight part and trisorbitan stearate (HLB: 1.5) of 25 weight part, and normal paraffin (average molecular weight 640) of 17 weight part were placed in a glass vessel having a cap, and were agitated and melted at a temperature of 180 degrees Celsius using a hot stirrer. Then, the melted protective agent was poured in an internal space of an aluminum metal mold, having a size of 12 mm×8 mm×350 mm, heated to 115 degrees Celsius in advance. After cooling to 90 degrees Celsius on a wooden table, the aluminum metal mold is cooled to 40 degrees Celsius on an aluminum table. Then, the solidified product is removed from the mold, and cooled to an ambient temperature while placing a weight on the product for preventing a warping. After that, a protective agent bar No. 2 having a size of 7 mm×8 mm×310 mm was prepared by cutting some portion of the product. The protective agent bar No. 2 was attached with a double face tape and fixed to a metal supporter.

By using such prepared protective agent bars Nos. 1 and 2, the photoconductor drum was applied with the protective agent for 40 minutes.

Experiment 1

The photoconductor drum, a brush roller (polyester single fiber having a diameter of 33 μm, fiber density of 50,000 fibers per square inch, prepared by electrostatic implantation method), and a urethane blade were assembled in a protective agent setting unit and a process cartridge. The protective agent bar No. 2 was pressed to the brush with a spring force of 4.8 N to apply a protective agent to the photoconductor drum for 40 minutes. The photoconductor drum and the brush roller rotated at a linear velocity of 125 mm/sec and 146 mm/sec, respectively. In such preparation process, a developing unit and a charge roller were removed from the process cartridge.

The second area value A of the photoconductor drum after applying the protective agent was detected as 0% by using an XPS analysis. Accordingly, a coating ratio of the photoconductor drum, defined by $((A_0-A)/A_0\times100)(\%)$, was measured as 100%.

As above described, the A and $A_0$ are a ratio of peak area of 290.3 eV to 294 eV with respect to a total area of C1s spectrum when a surface of the photoconductor drum is analyzed by XPS, in which the $A_0$ is a peak area ratio before applying protective agent, and the A is a peak area ratio after applying protective agent. Based on XPS results of the photoconductor drum Nos. 1 and 2, the $A_0$ was measured as 8.7% ($A_{0\text{-}ave}$=8.7%) for the photoconductor drum used in the experiment.

Figure 7:
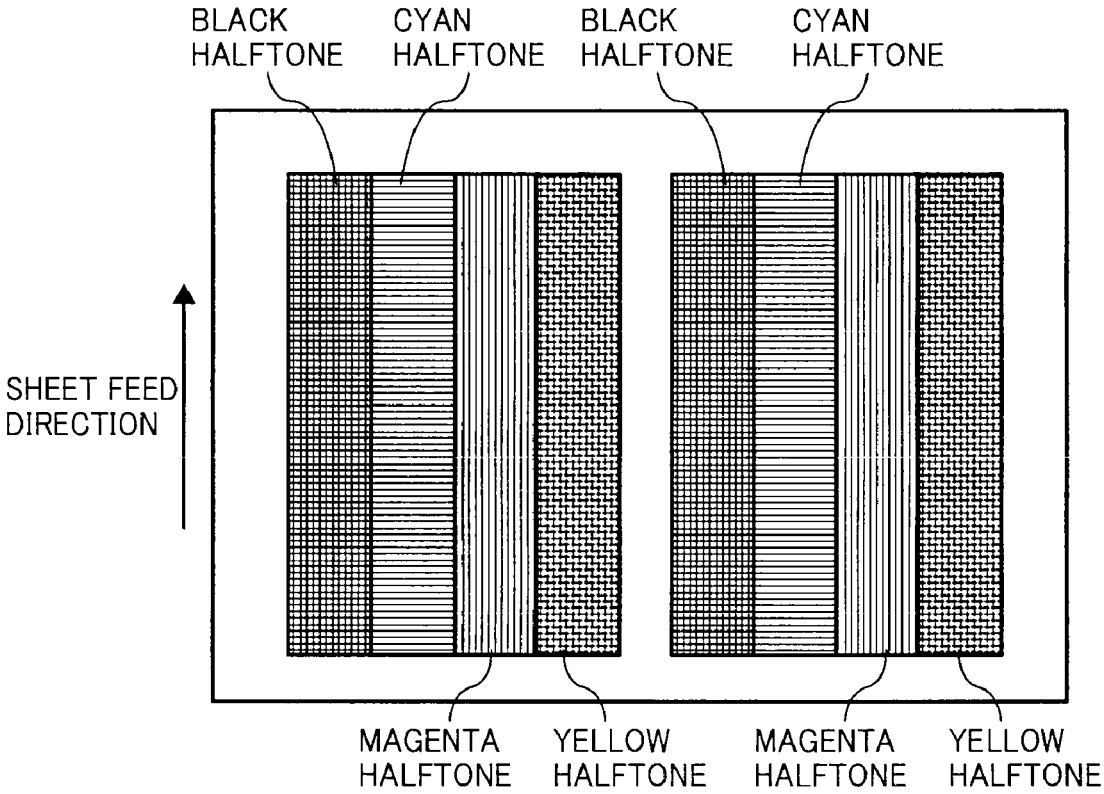
FIG. 7 illustrates an image pattern used for evaluating a process cartridge according to exemplary embodiments.

FIG. 7 illustrates evaluation image patterns used for the experiment. As shown in FIG. 7, stripe halftone images of each colors of black, cyan, magenta, and yellow are formed side by side. When evaluating performance of an image forming apparatus used for the experiment, such evaluation image pattern was used as a test image, and the image forming apparatus was operated to copy such test image on a greater number of sheets. The copied image quality was checked based on image evaluation criteria.

When evaluating performance of an image forming apparatus, a new photoconductor drum was assembled in a process cartridge as the photoconductor drum, and the protective agent was applied to the photoconductor drum for 40 minutes. Then, a developing unit and a charge roller were set in the process cartridge. The process cartridge was installed in IPSIO CX400, a tandem type color image forming apparatus produced by Ricoh Company, Ltd. In the process cartridge, the charge roller was disposed above the photoconductor drum, the photoconductor drum rotated at a linear velocity of 125 mm/sec, a superimposed voltage having a direct-current voltage of −600 V and an alternating-current voltage having a frequency 1450 Hz and an amplitude of 1100 V was applied between the photoconductor drum and the charge roller.

The image forming apparatus was operated to output 1,000 sheets of the evaluation image patterns of FIG. 7 to evaluate image quality. In Experiment 1, the image quality was evaluated to have a higher quality image. Then, another 4,000 sheets were further output, and the image quality was evaluated. The image quality was evaluated to have a higher quality image.

Experiment 2

Except a brush roller (polyester single fiber having a diameter of 39 μm, fiber density of 50,000 fibers per square inch, prepared by electrostatic implantation method), same devices used in Experiment 1 were used, and the protective agent was applied to the photoconductor drum for 40 minutes.

The second area value A of the photoconductor drum after applying the protective agent was detected as 0% using an XPS analysis. Accordingly, a coating ratio of the photoconductor drum, defined by $((A_0-A)/A_0\times100)(\%)$, was measured as 100%.

When evaluating performance of an image forming apparatus, a new photoconductor drum was assembled in a process cartridge as the photoconductor drum, and the protective agent was applied to the photoconductor drum for 40 minutes. Then, a developing unit and a charge roller were set in the process cartridge. The process cartridge was installed in IPSIO CX400, a tandem type color image forming apparatus produced by Ricoh Company, Ltd. In the process cartridge, the charge roller was disposed above the photoconductor drum, the photoconductor drum had a linear velocity of 125 mm/sec, a superimposed voltage having a direct-current voltage of −600 V and an alternating voltage having a frequency 1450 Hz and an amplitude of 1100 V was applied between the photoconductor drum and the charge roller.

The image forming apparatus was operated to output 1,000 sheets of the evaluation image patterns of FIG. 7 to evaluate image quality. In Experiment 2, the image quality was evaluated to have a higher quality image. Then, another 4,000 sheets were further output, and the image quality was evaluated. The image quality was evaluated to have a higher quality image.

Experiment 3

Except a brush roller (polyester single fiber having a diameter of 39 μm, fiber density of 30,000 fibers per square inch, prepared by electrostatic implantation method) and pressing the protective agent bar No. 1 with a spring force of 2N, same devices used in Experiment 1 were used, and a protective agent was applied to the photoconductor drum for 40 minutes.

The second area value A of the photoconductor drum after applying protective agent was detected as 4.8% using an XPS analysis. Accordingly, a coating ratio of the photoconductor drum, defined by $((A_0-A)/A_0\times100)(\%)$, was measured as 45%, in which the first area value $A_0$ was 8.7% as above described.

When evaluating performance of an image forming apparatus, a new photoconductor drum was assembled in a process cartridge as the photoconductor drum, and the protective agent was applied to the photoconductor drum for 40 minutes. Then, a developing unit and a charge roller were set in the process cartridge. The process cartridge was installed in IPSIO CX400, a tandem type color image forming apparatus produced by Ricoh Company, Ltd. In the process cartridge, the charge roller was disposed above the photoconductor drum, the photoconductor drum had a linear velocity of 125 mm/sec, a superimposed voltage having a direct-current voltage of −600 V and an alternating voltage having a frequency 1450 Hz and an amplitude of 1100 V was applied between the photoconductor drum and the charge roller.

The image forming apparatus was operated to output 1,000 sheets of the evaluation image patterns of FIG. 7 to evaluate image quality. In Experiment 3, the image quality was evaluated to have defective images such as faint streak-like image. Then, another 4,000 sheets were further output, and the image quality was evaluated. The image quality was evaluated to have defective images, such as faint streak-like image.

Experiment 4

Except using the protective agent bar No. 1, same devices used in Experiment 1 were used, and a protective agent was applied to the photoconductor drum for 40 minutes. As similar to Experiment 1, a coating ratio of the photoconductor drum, defined by $((A_0-A)/A_0\times100)(\%)$, was measured as 100%.

When evaluating performance of an image forming apparatus, a new photoconductor drum was assembled in a process cartridge as the photoconductor drum, and the protective agent was applied to the photoconductor drum with a same method of other experiments, and the process cartridge was installed in the image forming apparatus similarly as other experiments. The image forming apparatus was operated to output 5,000 sheets of the evaluation image patterns of FIG. 7 to evaluate image quality. In Experiment 4, the image quality was evaluated to have a higher quality image.

Experiments 5 to 9

The protective agent bar No. 1 was pulverized by a pulverization machine to prepare protective agent powders having an average particle diameter of 20 μm, and used in Experiments 5 to 9. A blade was contacted to the photoconductor drum in a counter direction to adjust a thickness of protective agent powders, supplied on the photoconductor drum. Five photoconductor drums were prepared by changing an application time of protective agent powders to set different coating ratios of 58%, 64%, 72%, 86%, and 98% for Experiments 5 to 9 with a similar manner of Experiment 1. Each of the five photoconductor drums was installed in a process cartridge used in Experiment 4 while using a brush roller (polyester single fiber having a diameter of 30 μm, fiber density of 55,000 fibers per square inch, prepared by electrostatic implantation method), and then the process cartridge was installed in the image forming apparatus.

As similar to Experiment 1, the image forming apparatus was operated to output 4,000 sheets of the evaluation image patterns of FIG. 7 to evaluate image quality using the photoconductor drum having the coating ratio of 58% (Experiment 5). In Experiment 5, the image quality was evaluated to have defective images, such as faint streak-like image.

Further, as similar to Experiment 1, the image forming apparatus was operated to output sheets of the evaluation image patterns of FIG. 7 to evaluate image quality using the photoconductor drum having the coating ratio of 64% (Experiment 6). In Experiment 6, the image quality was evaluated to have reasonable image quality, allowable for actual usage but having a little defective image, such as streak-like image, if the image was stared in detail.

Further, as similar to Experiment 1, the image forming apparatus was operated to output sheets of the evaluation image patterns of FIG. 7 to evaluate image quality using the photoconductor drum having the coating ratio of 72%, 86%, and 98% (Experiments 7, 8, and 9). In Experiments 7, 8, and 9, the image quality was evaluated to have a higher quality image.

Experiments 10 to 14

As similar to Experiments 5 to 9, five photoconductor drums having different coating ratio of protective agent powders were prepared. Then, five process cartridges having such photoconductor drums were prepared as similar to Experiments 5 to 9 except that the charge roller was applied only a direct-current voltage and changing a surface potential of the photoconductor drum right after the charging process to −600±25 V. Each of the process cartridges was installed in the image forming apparatus.

As similar to Experiment 1, the image forming apparatus was operated to output 4,000 sheets of the evaluation image patterns of FIG. 7 to evaluate image quality using the photoconductor drum having the coating ratio of 58% (Experiment 10). In Experiment 10, the image quality was evaluated to have defective images, such as faint streak-like image.

Further, as similar to Experiment 1, the image forming apparatus was operated to output 4,000 sheets of the evaluation image patterns of FIG. 7 to evaluate image quality using the photoconductor drum having the coating ratio of 64%, 72%, 86%, and 98% (Experiments 11, 12, 13, and 14). In Experiments 11, 12, 13, and 14, the image quality was evaluated to have a higher quality image.

Experiment 15

The photoconductor drum was heated to a temperature of 120 degrees Celsius by a ceramic heater, and the protective agent bar No. 1 was pressed to the photoconductor drum with a spring force of 0.5 N, and then the protective agent bar No. 1 is separated from the photoconductor drum. A urethane blade was contacted to the photoconductor drum in a counter direction and the photoconductor drum rotated for 30 seconds at a linear velocity of 140 mm/sec, and then cooled, by which the protective agent was applied to the photoconductor drum.

A coating ratio, measured as similar to Experiment, of the photoconductor drum 1 after applying protective agent, defined by $((A_0-A)/A_0\times100)(\%)$, was measured as 95%.

A process cartridge including such photoconductor drum was prepared as similar to Experiment 4 and installed in the image forming apparatus. The image forming apparatus was operated to output 4,000 sheets of the evaluation image patterns of FIG. 7 to evaluate image quality. In Experiment 15, the image quality was evaluated to have a higher quality image.

Experiment 16

Except coating the photoconductor drum by zinc stearate as a protective agent instead of using the protective agent bars Nos. 1 and 2, a process cartridge was prepared as similar to Experiment 15 and installed in the image forming apparatus. The image forming apparatus was operated to output 7,500 sheets of the evaluation image patterns of FIG. 7 to evaluate image quality. In Experiment 16, the image quality was evaluated to have defective images, such as faint streak-like image.

FIG. 8 shows the result of the experiments, in which evaluation result is classified in three levels: A) higher quality image; B) no defective images is observed by human eye but can be observed when magnified by a microscope (image quality is practically allowable); and C) not allowable image.

As above described, a photoconductor effectively applied with a protective agent in advance according to an exemplary embodiment can be installed in a process cartridge or an image forming apparatus. Accordingly, such process cartridge or image forming apparatus can be used to produce images having higher quality.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A process cartridge, comprising:

a photoconductor having a surface comprising polycarbonate, on which a latent image is to be formed;

a protective agent comprising paraffin as a main component pre-applied to the surface of the photoconductor in a particular coating condition prior to first operation of said process cartridge;

a charging unit configured to uniformly charge the photoconductor;

a development unit configured to develop the latent image formed on the surface of photoconductor as a toner image using a developing agent including toner particles;

a cleaning unit configured to remove toner particles remaining on the surface of the photoconductor after the toner image is transferred to a transfer member; and an application unit configured to apply additional protective agent to the surface of photoconductor during operation thereof, wherein said particular coating condition is determined by analyzing a C1s spectrum of the photoconductor, which is detected by X-ray photoelectron spectroscopy (XPS) before and after applying the protective agent to the photoconductor, the C1s spectrum including a plurality of peaks, corresponding to different carbon binding energy, one of the plurality of peaks in a binding energy range of 290.3 eV to 294 eV used as a target peak to determine the coating condition of the photoconductor coated by the protective agent, a peak area of the target peak with respect to a total area of the C1s spectrum of the photoconductor detected before and after applying the protective agent as a first peak area ratio $A_0$(%) and a second peak area ratio A(%) to determine the coating condition of the photoconductor, the first peak area ratio $A_0$(%) detected as a value before applying the protective agent, the photoconductor having the first peak area ratio $A_0$(%) of 3% or more employed, the second peak area ratio A(%) detected as a value after applying the protective agent, the photoconductor is pre-applied with the protective agent having a coating ratio of 60% or more, computed by $(A_0-A)/A_0\times100(\%)$.

2. The process cartridge according to claim 1, wherein the protective agent has a component detectable as an agent-attributed peak in the range of 290.3 eV to 294 eV and set to an amount such that a peak area of the agent-attributed peak is 1% or less of the total area of the C1s spectrum.

3. The process cartridge according to claim 1, further comprising a brush roller configured to apply the protective agent to the photoconductor, the brush roller having a metal core and a number of fibers formed on the metal core by an electrostatic implantation method with a fiber density of 50,000 to 600,000 fibers per square inch, each of the fibers having a diameter of from 28 μm to 42 μm.

4. The process cartridge according to claim 1, wherein when the charging unit is supplied with a superimposed voltage having an alternating-current voltage and superimposed with direct-current voltage to charge the photoconductor, the photoconductor is applied with a coating ratio of 70% or more, computed by $(A_0-A)/A_0\times100(\%)$.

5. An image forming apparatus comprising the process cartridge according to claim 1.

6. The image forming apparatus according to claim 5, wherein when the charging unit is supplied with a superimposed voltage having an alternating-current voltage superimposed with direct-current voltage to charge the photoconductor, the photoconductor is applied with a coating ratio of 70% or more, computed by $(A_{0-A)/A0}\times100(\%)$.

7. A method of detecting a surface condition of a photoconductor configured to be used in an image forming apparatus, the photoconductor configured to be coated with a protective agent comprising paraffin as a main component when used in the image forming apparatus, comprising:

a) measuring a C1s spectrum of the photoconductor having polycarbonate;

b) determining a surface condition of the photoconductor before the protective agent is applied to the photoconductor by detecting a target range of binding energy of the photoconductor in the C1s spectrum, the surface condition before applying the protective agent determined as a first peak area ratio $A_0$(%) with respect to a total peak area of the C1s spectrum, the photoconductor having the first peak area ratio $A_0$(%) of 3% or more is employed and the target range of binding energy corresponds to a binding energy of the polycarbonate;

c) determining a surface condition of the photoconductor after the protective agent is applied to the photoconductor by detecting the target range of binding energy of the photoconductor in the C1s spectrum, the surface condition after applying the protective agent is determined as a second peak area ratio A(%) with respect to a total peak area of the C1s spectrum; and d) computing a coating ratio of the photoconductor coated by the protective agent as $(A_0-A)/A_0\times100(\%)$.

8. The process cartridge according to claim 4, wherein the coating ratio is 75% or more.

9. The process cartridge according to claim 4, wherein the coating ratio is 80% or more.

10. The process cartridge according to claim 1, wherein the protective agent comprises paraffin in an amount of 60 wt % or more.

11. The process cartridge according to claim 1, wherein the protective agent comprises paraffin in an amount of 70 wt % or more.

12. The process cartridge according to claim 1, wherein the protective agent additionally comprises fine particles of an inorganic compound dispersed therein.

13. A method of forming a photoconductor having a surface comprising polycarbonate, on which a latent image is to be formed, and a protective agent comprising paraffin as a main component applied to the surface of the photoconductor in a particular coating condition, comprising applying said protective agent to the surface of said photoconductor, wherein said particular coating condition is determined by analyzing a C1s spectrum of the photoconductor, which is detected by X-ray photoelectron spectroscopy (XPS) before and after applying the protective agent to the photoconductor, the C1s spectrum including a plurality of peaks, corresponding to different carbon binding energy, one of the plurality of peaks in a binding energy range of 290.3 eV to 294 eV used as a target peak to determine the coating condition of the photoconductor coated by the protective agent, a peak area of the target peak with respect to a total area of the C1s spectrum of the photoconductor detected before and after applying the protective agent as a first peak area ratio $A_0$(%) and a second peak area ratio A(%) to determine the coating condition of the photoconductor, the first peak area ratio $A_0$(%) detected as a value before applying the protective agent, the photoconductor having the first peak area ratio $A_0$(%) of 3% or more employed, the second peak area ratio A(%) detected as a value after applying the protective agent, the photoconductor is applied with the protective agent having a coating ratio of 60% or more, computed by $(A_0-A)/A_0\times100(\%)$.

14. The method according to claim 13, wherein the coating ratio is 75% or more.

15. The method according to claim 13, wherein the coating ratio is 80% or more.

16. The method according to claim 13, wherein the protective agent comprises paraffin in an amount of 60 wt % or more.

17. The method according to claim 13, wherein the protective agent comprises paraffin in an amount of 70 wt % or more.

18. The method according to claim 13, wherein the protective agent additionally comprises fine particles of an inorganic compound dispersed therein.

* * * * *